US008149258B2

(12) United States Patent
Tominaga

(10) Patent No.: US 8,149,258 B2
(45) Date of Patent: Apr. 3, 2012

(54) IMAGE FORMING APPARATUS AND CONTROL METHOD

(75) Inventor: Hidekazu Tominaga, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 869 days.

(21) Appl. No.: 12/163,907

(22) Filed: Jun. 27, 2008

(65) Prior Publication Data

US 2009/0003862 A1 Jan. 1, 2009

(30) Foreign Application Priority Data

Jun. 29, 2007 (JP) ..... 2007-172748
Jun. 5, 2008 (JP) ..... 2008-148203

(51) Int. Cl.
*B41J 2/435* (2006.01)
*B41J 2/47* (2006.01)

(52) U.S. Cl. ..... 347/237; 347/247

(58) Field of Classification Search ..... 347/236, 347/237, 240, 246, 247, 251–254, 243, 259–261
See application file for complete search history.

(56) References Cited

U.S. PATENT DOCUMENTS 7,003,241 B1 * 2/2006 Kobayashi et al. ..... 399/72
7,728,856 B2 * 6/2010 Chino ..... 347/135
2008/0124125 A1 * 5/2008 Hirano ..... 399/151

FOREIGN PATENT DOCUMENTS

JP 04-200065 A 7/1992

* cited by examiner

*Primary Examiner* — Hai C Pham
(74) *Attorney, Agent, or Firm* — Canon USA, Inc., I.P. Division

(57) ABSTRACT

For suppressing density unevenness which is caused by changes in a main scanning line interval of a laser beam on the image bearing member due to a polygonal face tangle, laser luminance is controlled so as to maintain the density unevenness with a spatial frequency sensitive to human visibility substantially constant.

5 Claims, 20 Drawing Sheets

| DIFFERENCE | -10.2 | -10.4 | 0.3 | -2.9 | 3.9 | 9.1 | -17.0 | 21.1 | -19.9 | 5.3 | △ |
|---|---|---|---|---|---|---|---|---|---|---|---|
| INTEGRAL DIFFERENCE | -10.2 | 0.2 | 0.5 | -2.4 | 1.5 | 10.6 | -6.4 | 14.7 | -5.1 | 0.2 | |
| INTEGRAL DIFFERENCE - AVERAGE | -10.5 | -0.1 | 0.1 | -2.8 | 1.1 | 10.2 | -6.7 | 14.4 | -5.5 | -0.2 | ○ |
| ABSOLUTE DISPLACEMENT | 0.7 | 0.3 | 0.5 | -0.4 | -1.5 | -0.8 | 0.1 | 0.6 | 0.1 | 0.4 | ○ |
| (1) REFERENCE DISPLACEMENT | 0.0 | -0.4 | -0.2 | -1.1 | -2.2 | -1.5 | -0.6 | -0.1 | -0.6 | -0.3 | △ |
| | (1) | (2) | (3) | (4) | (5) | (6) | (7) | (8) | (9) | (10) | |

FIG. 4

| σ | GAUSSIAN DISTRIBUTION (AREA) |
|---|---|
| - 3 | 0.13% |
| - 2.9 | 0.19% |
| - 2.8 | 0.26% |
| | 0.35% |
| | |
| - 0.9 | 18.40% |
| - 0.8 | 21.20% |
| - 0.7 | 24.20% |
| | 27.40% |
| | |
| 2.7 | |
| 2.8 | 99.74% |
| 2.9 | 99.87% |
| 3 | 99.90% |

FIG. 5A
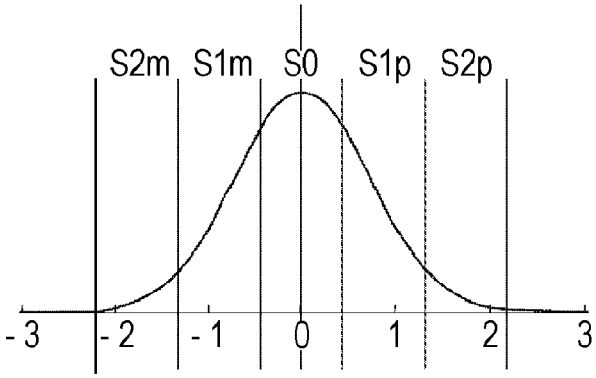
FIG. 5B
| | |
|---|---|
| S2m | 8.35% |
| S1m | 23.47% |
| S0 | 33.11% |
| S1p | 23.47% |
| S2p | 8.35% |
FIG. 6A
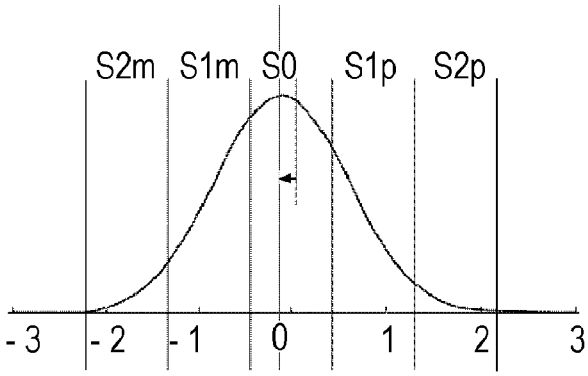
FIG. 6B
| | |
|---|---|
| S2m | 9.49% |
| S1m | 24.97% |
| S0 | 33.01% |
| S1p | 21.19% |
| S2p | 7.31% |

FIG. 9A
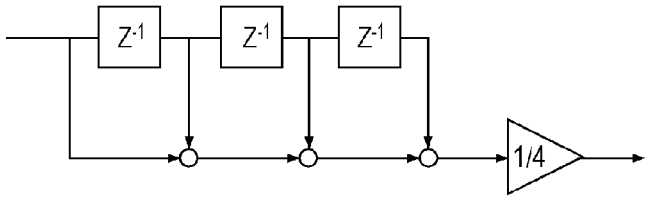
FIG. 9B
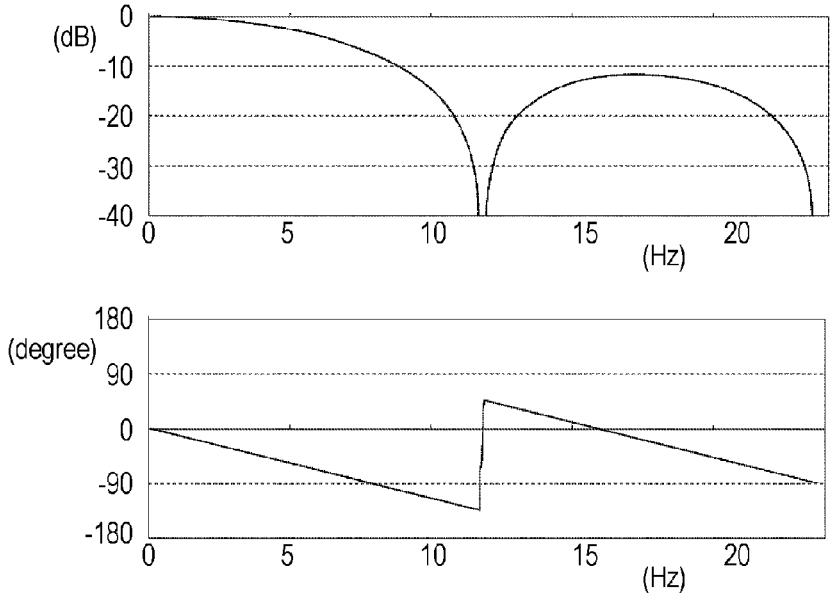
FIG. 9C
| FREQUENCY | 0.98 | 3.93 | 2.95 | 3.93 | 5.90 | 7.87 | 11.80 | Hz |
|---|---|---|---|---|---|---|---|---|
| PERIOD | 48 | 12 | 16 | 12 | 8 | 6 | 4 | LINE PERIOD |
| GAIN | -0.08 | -1.50 | -0.83 | -1.50 | -3.63 | -7.20 | $-\infty$ | dB |

FIG. 11A

| 1ST FACE | | | | 2ND FACE | | | | 3RD FACE | | | | 4TH FACE | | | |
|---|---|---|---|---|---|---|---|---|---|---|---|---|---|---|---|
| D1 | C1 | B1 | A1 | D2 | C2 | B2 | A2 | D3 | C3 | B3 | A3 | D4 | C4 | B4 | A4 |
| -0.15 μm | 1.32 μm | -3.28 μm | -2.85 μm | -0.04 μm | 1.10 μm | -3.72 μm | -3.16 μm | -1.29 μm | 0.98 μm | -4.57 μm | -3.90 μm | -2.49 μm | -1.21 μm | -6.06 μm | -5.29 μm |

| 5TH FACE | | | | 6TH FACE | | | | 7TH FACE | | | | 8TH FACE | | | |
|---|---|---|---|---|---|---|---|---|---|---|---|---|---|---|---|
| D5 | C5 | B5 | A5 | D6 | C6 | B6 | A6 | D7 | C7 | B7 | A7 | D8 | C8 | B8 | A8 |
| -3.60 μm | -2.46 μm | -7.75 μm | -6.77 μm | -4.26 μm | -3.31 μm | -7.99 μm | -7.19 μm | -4.27 μm | -2.94 μm | -8.17 μm | -7.30 μm | -4.44 μm | -2.79 μm | -7.63 μm | -7.07 μm |

| 9TH FACE | | | | 10TH FACE | | | | 11TH FACE | | | | 12TH FACE | | | |
|---|---|---|---|---|---|---|---|---|---|---|---|---|---|---|---|
| D9 | C9 | B9 | A9 | D10 | C10 | B10 | A10 | D11 | C11 | B11 | A11 | D12 | C12 | B12 | A12 |
| -2.83 μm | -2.18 μm | -7.27 μm | -6.58 μm | -2.05 μm | -0.80 μm | -6.37 μm | -5.34 μm | -1.15 μm | -0.09 μm | -4.91 μm | -3.83 μm | -0.16 μm | -1.49 μm | -3.52 μm | -2.85 μm |

FIG. 11B

| | 1ST FACE | | | | 2ND FACE | | | | 3RD FACE | | | | 4TH FACE | | | |
|---|---|---|---|---|---|---|---|---|---|---|---|---|---|---|---|---|
| | D1 | C1 | B1 | A1 | D2 | C2 | B2 | A2 | D3 | C3 | B3 | A3 | D4 | C4 | B4 | A4 |
| N | 1 | 2 | 3 | 4 | 5 | 6 | 7 | 8 | 9 | 10 | 11 | 12 | 13 | 14 | 15 | 16 |
| ×(N) | 0.993 | 0.993 | 0.993 | 0.993 | 0.98 | 0.98 | 0.98 | 0.98 | 0.982 | 0.982 | 0.982 | 0.982 | 0.952 | 0.952 | 0.952 | 0.952 |

| | 5TH FACE | | | | 6TH FACE | | | | 7TH FACE | | | | 8TH FACE | | | |
|---|---|---|---|---|---|---|---|---|---|---|---|---|---|---|---|---|
| | D1 | C1 | B1 | A1 | D2 | C2 | B2 | A2 | D3 | C3 | B3 | A3 | D4 | C4 | B4 | A4 |
| N | 17 | 18 | 19 | 20 | 21 | 22 | 23 | 24 | 25 | 26 | 27 | 28 | 29 | 30 | 31 | 32 |
| ×(N) | 0.985 | 0.985 | 0.985 | 0.985 | 0.987 | 0.987 | 0.987 | 0.987 | 1.005 | 1.005 | 1.005 | 1.005 | 1.01 | 1.01 | 1.01 | 1.01 |

| | 9TH FACE | | | | 10TH FACE | | | | 11TH FACE | | | | 12TH FACE | | | |
|---|---|---|---|---|---|---|---|---|---|---|---|---|---|---|---|---|
| | D1 | C1 | B1 | A1 | D2 | C2 | B2 | A2 | D3 | C3 | B3 | A3 | D4 | C4 | B4 | A4 |
| N | 33 | 34 | 35 | 36 | 37 | 38 | 39 | 40 | 41 | 42 | 43 | 44 | 45 | 46 | 47 | 48 |
| ×(N) | 1.015 | 1.015 | 1.015 | 1.015 | 1.03 | 1.03 | 1.03 | 1.03 | 1.02 | 1.02 | 1.02 | 1.02 | 1.033 | 1.033 | 1.033 | 1.033 |

| 1ST FACE | | | | 2ND FACE | | | | 3RD FACE | | | | 4TH FACE | | | |
|---|---|---|---|---|---|---|---|---|---|---|---|---|---|---|---|
| D1 | C1 | B1 | A1 | D2 | C2 | B2 | A2 | D3 | C3 | B3 | A3 | D4 | C4 | B4 | A4 |
| 1.00 | 1.00 | 0.99 | 1.03 | 0.99 | 0.95 | 0.95 | 1.05 | 0.98 | 0.95 | 0.92 | 1.03 | 1.00 | 0.94 | 0.92 | 0.94 |

| 5TH FACE | | | | 6TH FACE | | | | 7TH FACE | | | | 8TH FACE | | | |
|---|---|---|---|---|---|---|---|---|---|---|---|---|---|---|---|
| D1 | C1 | B1 | A1 | D2 | C2 | B2 | A2 | D3 | C3 | B3 | A3 | D4 | C4 | B4 | A4 |
| 1.01 | 0.98 | 0.98 | 0.99 | 0.99 | 0.98 | 0.99 | 0.99 | 1.01 | 1.00 | 1.00 | 1.01 | 1.01 | 1.01 | 1.01 | 1.01 |

| 9TH FACE | | | | 10TH FACE | | | | 11TH FACE | | | | 12TH FACE | | | |
|---|---|---|---|---|---|---|---|---|---|---|---|---|---|---|---|
| D1 | C1 | B1 | A1 | D2 | C2 | B2 | A2 | D3 | C3 | B3 | A3 | D4 | C4 | B4 | A4 |
| 1.02 | 1.01 | 1.01 | 1.02 | 1.03 | 0.98 | 1.01 | 1.05 | 1.01 | 1.01 | 1.01 | 1.01 | 1.04 | 1.02 | 1.01 | 1.01 |

| 1ST FACE | | | | | |
|---|---|---|---|---|---|
| F1 | E1 | D1 | C1 | B1 | A1 |
| 2.35 | 2.72 | 2.27 | 1.45 | 1.63 | 4.05 |
| 2ND FACE | | | | | |
| F2 | E2 | D2 | C2 | B2 | A2 |
| 4.47 | 4.30 | 3.27 | 1.60 | 2.52 | 2.54 |
| 3RD FACE | | | | | |
| F3 | E3 | D3 | C3 | B3 | A3 |
| 2.42 | 1.76 | 0.04 | -0.74 | -1.46764 | -1.87233 |
| 4TH FACE | | | | | |
| F4 | E4 | D4 | C4 | B4 | A4 |
| 2.35 | 2.72 | 2.27 | 1.45 | 1.63 | 4.05 |
| 5TH FACE | | | | | |
| F5 | E5 | D5 | C5 | B5 | A5 |
| -0.59 | -0.44 | -1.06 | -1.86 | -1.36 | 0.99 |

| RESOLUTION | FACE | NUMBER OF BEAMS | | LINE | PITCH(mm) | line/mm | VISIBILITY |
|---|---|---|---|---|---|---|---|
| 1200 | 5 | 6 | 1 | 30 | 0.635 | 1.57 | 0.928 |
| 1200 | 5 | 6 | 2 | 15 | 0.318 | 3.15 | 0.456 |
| 1200 | 5 | 6 | 3 | 10 | 0.212 | 4.72 | 0.176 |
| 1200 | 5 | 6 | 5 | 6 | 0.127 | 7.87 | 0.022 |
| 1200 | 5 | 6 | 6 | 5 | 0.106 | 9.45 | 0.007 |
| 1200 | 5 | 6 | 10 | 3 | 0.064 | 15.75 | 0.000 |
| 1200 | 5 | 6 | 15 | 2 | 0.042 | 23.62 | 0.000 |
| 1200 | 5 | 6 | 30 | 1 | 0.021 | 47.24 | 0.000 |

FIG. 16A
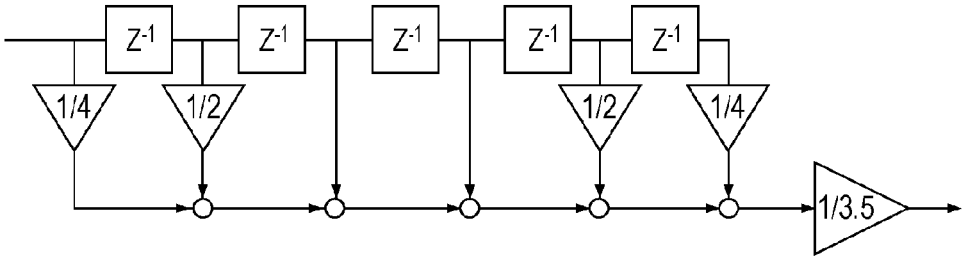
FIG. 16B
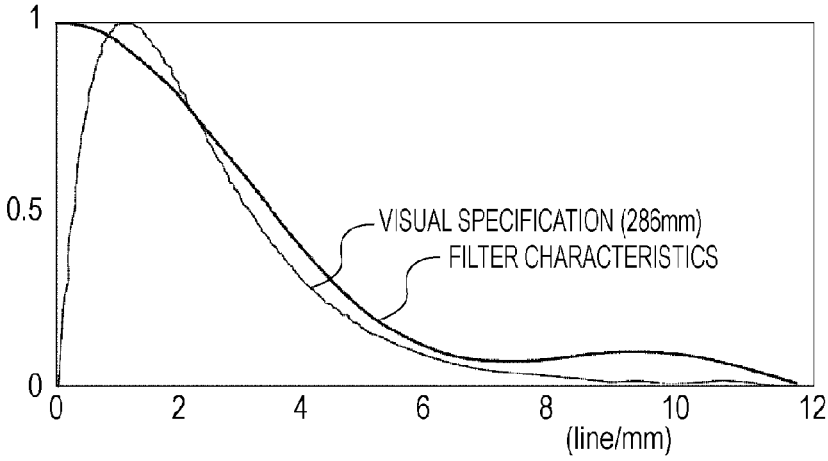
FIG. 16C
| | 2 | 4 | 6 | 8 |
|---|---|---|---|---|
| VISIBILITY (573mm) | 0.8 | 0.28 | 0.08 | 0.02 |
| FIR FILTER | 0.78 | 0.36 | 0.09 | 0.07 |
(line/mm)

FIG. 18

| 1ST FACE | | | | | |
|---|---|---|---|---|---|
| F1 | E1 | D1 | C1 | B1 | A1 |
| 1.07 | 0.98 | 0.98 | 1.00 | 1.06 | 1.07 |
| 2ND FACE | | | | | |
| F2 | E2 | D2 | C2 | B2 | A2 |
| 1.00 | 0.96 | 0.97 | 0.99 | 1.00 | 1.00 |
| 3RD FACE | | | | | |
| F3 | E3 | D3 | C3 | B3 | A3 |
| 0.99 | 0.95 | 0.95 | 0.97 | 0.98 | 1.01 |
| 4TH FACE | | | | | |
| F4 | E4 | D4 | C4 | B4 | A4 |
| 1.00 | 0.98 | 0.97 | 0.98 | 0.99 | 1.07 |
| 5TH FACE | | | | | |
| F5 | E5 | D5 | C5 | B5 | A5 |
| 1.06 | 1.00 | 0.98 | 0.99 | 1.07 | 1.07 |

FIG. 19A

| | MAXIMUM | MINIMUM | AVERAGE | STANDARD DEVIATION |
|---|---|---|---|---|
| EMBODIMENT | 1.070 | 0.950 | 1.003 | 0.039 |

FIG. 19B

| | TOTAL EXPOSURE VALUE | | | | FIR LPF APPLIED | | | |
|---|---|---|---|---|---|---|---|---|
| | MAXIMUM | MINIMUM | AVERAGE | STANDARD DEVIATION | MAXIMUM | MINIMUM | AVERAGE | STANDARD DEVIATION |
| EMBODIMENT | 1.046 | 0.968 | 1.003 | 0.022 | 1.105 | 0.993 | 1.003 | 0.007 |

FIG. 20A

| RESOLUTION | FACE | NUMBER OF BEAMS | | LINE | PITCH(mm) | line/mm | VISIBILITY |
|---|---|---|---|---|---|---|---|
| 4800 | 5 | 8 | 1 | 40 | 0.212 | 4.72 | 0.176 |
| 4800 | 5 | 8 | 2 | 20 | 0.106 | 9.45 | 0.007 |
| 4800 | 5 | 8 | 4 | 10 | 0.053 | 18.90 | 0.000 |
| 4800 | 5 | 8 | 5 | 8 | 0.042 | 23.62 | 0.000 |
| 4800 | 5 | 8 | 8 | 5 | 0.026 | 37.80 | 0.000 |
| 4800 | 5 | 8 | 10 | 4 | 0.021 | 47.24 | 0.000 |
| 4800 | 5 | 8 | 20 | 2 | 0.011 | 94.49 | 0.000 |
| 4800 | 5 | 8 | 40 | 1 | 0.005 | 188.98 | 0.000 |

FIG. 20B

| RESOLUTION | FACE | NUMBER OF BEAMS | | LINE | PITCH(mm) | line/mm | VISIBILITY |
|---|---|---|---|---|---|---|---|
| 2400 | 10 | 5 | 1 | 50 | 0.529 | 1.89 | 0.838 |
| 2400 | 10 | 5 | 2 | 25 | 0.265 | 3.78 | 0.316 |
| 2400 | 10 | 5 | 5 | 10 | 0.106 | 9.45 | 0.007 |
| 2400 | 10 | 5 | 10 | 5 | 0.053 | 18.90 | 0.000 |
| 2400 | 10 | 5 | 25 | 2 | 0.021 | 47.24 | 0.000 |
| 2400 | 10 | 5 | 50 | 1 | 0.011 | 94.49 | 0.000 |

FIG. 20C

| RESOLUTION | FACE | NUMBER OF BEAMS | | LINE | PITCH(mm) | line/mm | VISIBILITY |
|---|---|---|---|---|---|---|---|
| 1200 | 6 | 6 | 1 | 36 | 0.762 | 1.31 | 0.982 |
| 1200 | 6 | 6 | 2 | 18 | 0.381 | 2.62 | 0.603 |
| 1200 | 6 | 6 | 3 | 12 | 0.254 | 3.94 | 0.287 |
| 1200 | 6 | 6 | 4 | 9 | 0.191 | 5.25 | 0.125 |
| 1200 | 6 | 6 | 6 | 6 | 0.127 | 7.87 | 0.022 |
| 1200 | 6 | 6 | 9 | 4 | 0.085 | 11.81 | 0.001 |
| 1200 | 6 | 6 | 12 | 3 | 0.064 | 15.75 | 0.000 |
| 1200 | 6 | 6 | 18 | 2 | 0.042 | 23.62 | 0.000 |
| 1200 | 6 | 6 | 36 | 1 | 0.021 | 47.24 | 0.000 |

FIG. 20D

| RESOLUTION | FACE | NUMBER OF BEAMS | | LINE | PITCH(mm) | line/mm | VISIBILITY |
|---|---|---|---|---|---|---|---|
| 600 | 8 | 4 | 1 | 32 | 1.355 | 0.74 | 0.937 |
| 600 | 8 | 4 | 2 | 16 | 0.677 | 1.48 | 0.952 |
| 600 | 8 | 4 | 4 | 8 | 0.339 | 2.95 | 0.508 |
| 600 | 8 | 4 | 8 | 4 | 0.169 | 5.91 | 0.081 |
| 600 | 8 | 4 | 16 | 2 | 0.085 | 11.81 | 0.001 |
| 600 | 8 | 4 | 32 | 1 | 0.042 | 23.62 | 0.000 |

IMAGE FORMING APPARATUS AND CONTROL METHOD

BACKGROUND OF THE INVENTION

1. Field of the Invention

The present invention relates to an electrophotographic image forming apparatus having a deflection scanning exposure unit such as a polygonal mirror for deflecting light.

2. Description of the Related Art

In the field of electrophotographic image forming apparatuses, a tandem type image forming apparatus has been known having a plurality of image forming sections, in which different color images are sequentially transferred on a recording material held on a conveying belt for speeding up.

FIGS. 21A and 21B show an example of the tandem-type color image forming apparatus. FIG. 21A is a general schematic view. This color image forming apparatus includes a transfer material cassette (not shown) mounted on the body bottom. The transfer materials placed on the transfer material cassette are taken one by one and supplied to the image forming section. In the image forming section, a transfer conveying belt 10 is flatly stretched along a plurality of rollers in a conveying direction of a transfer material and is driven by a drive motor 21 for conveying the transfer material. The transfer material is electrostatically attracted on the transfer conveying belt 10 by applying a bias on an absorption roller (not shown) arranged on the surface of the transfer conveying belt 10 on the most upstream side of the transfer conveying belt 10. Four photosensitive drums 14 are linearly arranged to oppose the belt conveyance surface as drum-type image bearing members. A developing unit that is the image forming section includes the photosensitive drum 14, each toner (not shown) for colors of C (cyan), Y (yellow) M (magenta), and K (black), a charger (not shown), and a developer (not shown). Within a casing of each developing unit, a predetermined space is provided between the charger and the developer, and through this space, the circumferential surface (the image bearing member surface) of the photosensitive drum 14 is exposed by an exposure unit 8 composed of at least one laser scanner.

FIG. 21B is a drawing showing the exposure unit 8 in detail. Referring to FIG. 21B, a divergent light beam (laser beam) emitted from a light source 1 is substantially collimated with a collimator lens 2; an aperture stop 3 limits the passing light beam (light quantity); a cylindrical lens (cylinder lens) 4 having predetermined refracting power in a sub-scanning direction focuses the light beam that has passed through the aperture stop 3 on a deflection surface 5*a* of a light deflector 5 (described below) within a sub-scanning section as a substantially linear image; a polygon mirror (rotatable polygonal mirror) 5 for deflecting light as a deflecting element is rotated at a predetermined speed in arrow A direction in the drawing by a drive unit (not shown) such as a motor; an optical element 6 having fθ characteristics is composed of a refraction unit and a diffraction unit; the refraction unit is formed of a single plastic toric lens 6-*a* having power different in a main scanning direction from that in a sub-scanning direction, and both lens surfaces of the toric lens 6-*a* in the main scanning direction are aspheric; the diffraction unit is formed of a long diffraction optical element 6-*b* having power different in a main scanning direction from that in a sub-scanning direction; and a beam detection sensor (BD sensor) 7 is arranged outside an image region for determining the writing timing in the main scanning direction. By writing images after a predetermined period of time since receiving a signal from the BD sensor 7, the process can be synchronized in the main scanning direction.

Each charger (not shown) uniformly charges the circumferential surface (image bearing member surface) of the corresponding photosensitive drum 14 with predetermined electric charge, and the exposure unit 8 exposes the charged circumferential surface of the photosensitive drum 14 (the image bearing member) in accordance with image information so as to form electrostatic latent images. Then, the developer (not shown) produces (develops) toner images by transferring toner to a low-potential portion of the electrostatic latent images. A transferring material (not shown) is positioned with the conveyance surface of the transfer conveying belt 10 therebetween. The toner images formed (developed) on the circumferential surface (image bearing member surface) of each corresponding photosensitive drum 14 are attracted and transferred onto the surface of the transfer material by an electric charge in the conveyed transfer material produced by the transfer electric field in the corresponding transfer material (not shown). The toner images transferred on the transfer material are thermally fixed on the sheet in a fixing unit (not shown) including a pressure roller and a heating roller, and the transfer material with the fixed toner images is discharged outside the apparatus. The transfer conveying belt 10 may also be an intermediate transfer belt, on which each toner for colors of C (cyan), Y (yellow) M (magenta), and K (black) is once transferred, and then is secondarily transferred on the transfer material. A tandem-type color printer includes the exposure unit 8 and the developing unit (not shown) for each toner for colors of C (cyan), Y (yellow) M (magenta), and K (black). Therefore, for executing main scanning magnification adjustment, main scanning writing position adjustment, and sub-scanning writing position adjustment, a patch (not shown) is depicted, and registration adjustment is performed based on patch information.

The conventional image forming apparatus described above experiences an unevenness of exposure due to the displacement between beams in a plurality of laser beams, polygonal axis tangle in the deflection scanning exposure unit, and sub-scanning exposure displacement followed by the polygonal face tangle. A primary reason for the exposure unevenness is micro-displacement of the beam for each polygonal face along the sub-scanning direction from the ideal sub-scanning exposure position. The exposure unevenness is accompanied by sinewave color density unevenness (due to the polygonal axis tangle) having a period corresponding to one rotation of the polygonal mirror, random color density unevenness due to the polygonal face tangle, and color density unevenness having a period corresponding to the number and relative displacement of the beams for each of the colors. The exposure unevenness is also accompanied by complicated color density unevenness due to a periodic beat. When there are two frequencies, for example, the periodic beat is formed of small fluctuations with a period of the difference between the two frequencies.

Conventionally, in order to suppress the sub-scanning displacement amount, a two-beam laser or four-beam laser has been used for a plurality of laser beams, or a plurality of laser units have been assembled with fine positional adjustment for eliminating the displacement amount. Also, in order to suppress the exposure unevenness due to the polygonal axis tangle in the deflection scanning exposure unit and the sub-scanning exposure displacement followed by the polygonal face tangle, a method for suppressing the sub-scanning exposure displacement amount has been employed by strictly controlling accuracy rating in polygonal axis tangle and polygonal face.

In such a manner, for speeding up the process and improving image quality, the accuracy rating requirement has a strong tendency to become very strict for the displacement between beams in a plurality of laser beams, polygonal axis tangle, and polygonal face tangle. Moreover, in the conventional method of strictly controlling accuracy rating in the displacement between beams in a plurality of laser beams, polygonal axis tangle, and polygonal face tangle, a problem arises in that productivity cannot be increased.

In Japanese Patent Laid-Open No. 04-200065 (described above), it is proposed that when a scanning pitch d in the sub-scanning direction is large, the exposure amount owing to semiconductor laser is increased, and when the scanning pitch d is small, the exposure amount owing to the semiconductor laser is decreased. The exposure amount per unit area is thereby maintained within a specified tolerance.

However, according to the exposure amount correction method of Japanese Patent Laid-Open No. 04-200065, with increasing change in sub-scanning displacement, higher performance is demanded of a semiconductor unit. For example, output characteristics and higher resolution are required along a wide operating range of the semiconductor unit, resulting in higher cost for the semiconductor unit.

Also, according to the exposure amount correction method of Japanese Patent Laid-Open No. 04-200065, although the method is functioning to suppress the unevenness of color density effectively to some extent, it has a problem of accuracy. The reason of the accuracy problem in Japanese Patent Laid-Open No. 04-200065 is specifically described below.

FIGS. 23A and 23B are drawings of dose distributions of laser light viewed in the sub-scanning direction; FIG. 23A shows the distributions when the resolution is 600 dpi; and FIG. 23B shows the distributions when the resolution is 2400 dpi. Referring to FIGS. 23A and 23B, an exposure spot of a laser beam on the drum surface is approximated by a Gaussian distribution, and the spot diameter in the sub-scanning direction (the size of a spot with the light quantity equaling or exceeding $(1/e^2)\times$the light quantity at the center of the spot) is 70 μm in FIG. 23A and is 50 μm in FIG. 23B. In the resolution 600 dpi of FIG. 23A, the sub-scanning line interval is 42.3 μm, which is comparatively large relative to the spot diameter, so that the bottom of the Gaussian distribution is contained roughly within a range bounded by one neighboring pixel along sub-scanning direction. Whereas, in the resolution 2400 dpi of FIG. 23B, the sub-scanning line interval is 10.6 μm, which is comparatively small relative to the spot diameter, so that the bottom of the Gaussian distribution is spread across four neighboring pixels. Thus, it is necessary to consider from one pixel to three pixels in the front and the rear of the noticed pixel in the sub-scanning direction. If the exposure amount is decreased when the pitch d between pixels is small, its influence extends across four neighboring pixels, so that the exposure amount is relatively decreased over the range of the four neighboring pixels. Conversely, if the exposure amount is increased when the pitch d between pixels is large, its influence extends across four neighboring pixels, so that the exposure amount is relatively increased over the range of the four neighboring pixels. In such a manner, when the pixels stand relatively close to each other in the sub-scanning direction, the exposure amount cannot be established only by the relationship with the adjacent pixel, so that it is understood that the correction control for maintaining the exposure amount per unit area constant is complex. In the relationship between the spot diameter and the resolution, if the spot diameter is larger than SQRT (2) (square root of 2) times the sub-scanning line interval (the scanning pitch d in the sub-scanning direction), the effect of the bottom of two neighboring pixels must be taken into consideration. If the resolution is improved without decreasing the spot diameter, other nearby pixels have a more pronounced impact and so must be taken into consideration.

SUMMARY OF THE INVENTION

Embodiments of the present invention are provided to overcome the above-described drawbacks of the conventional technology.

The present invention provides an image forming apparatus capable of efficiently suppressing the unevenness of color density due to the sub-scanning displacement of a laser beam by the correction of the exposure amount owing to the laser beam.

In a color image forming apparatus capable of suppressing color density unevenness due to exposure amount changes in a sub-scanning direction when forming images on an image bearing member by deflecting a laser beam with a rotatable polygonal mirror, the image forming apparatus includes an exposure amount correcting unit configured to correct an exposure amount so as to suppress exposure amount changes in a low-frequency component, from which exposure amount changes in a high-frequency component of the exposure amount changes in the sub-scanning direction are removed or suppressed.

According to the present invention, color density unevenness due to sub-scanning displacement of a laser beam can be efficiently suppressed by the correction of the exposure amount owing to the laser beam, thereby suppressing increase in cost due to wider output range of an exposure unit and higher resolving power.

Other features and advantages of the present invention will be apparent from the following description taken in conjunction with the accompanying drawings, in which like reference characters designate the same or similar parts throughout the figures there.

BRIEF DESCRIPTION OF THE DRAWINGS

FIG. 4 is a Gaussian-distribution corresponding table between σ and area.

FIGS. 5A and 5B are drawings for illustrating a Gaussian distribution without displacement in a sub-scanning direction.

FIGS. 6A and 6B are drawings for illustrating a Gaussian distribution with the displacement in the sub-scanning direction.

FIGS. 9A to 9C are drawings for showing an example of an FIR (finite impulse response) filter.

FIGS. 11A and 11B are tables showing an example of the displacement amount in the sub-scanning direction of each line and the luminance correction value.

FIGS. 16A to 16C are drawings for showing an example of an FIR (finite impulse response) filter according to the third embodiment.

FIG. 18 is a drawing showing an example of the luminance correction values according to the third embodiment.

FIGS. 19A and 19B are drawings showing an example of the luminance correction values according to the third embodiment.

FIGS. 20A to 20D are drawings for illustrating the relationship between the resolution and various values.

DESCRIPTION OF THE EMBODIMENTS

Various embodiments according to the present invention are described below by exemplifying them in detail with reference to the drawings. Components described in the embodiments are strictly for the purposes of exemplification, and the present invention is not limited to only these components or embodiments.

First Embodiment

Figure 1:
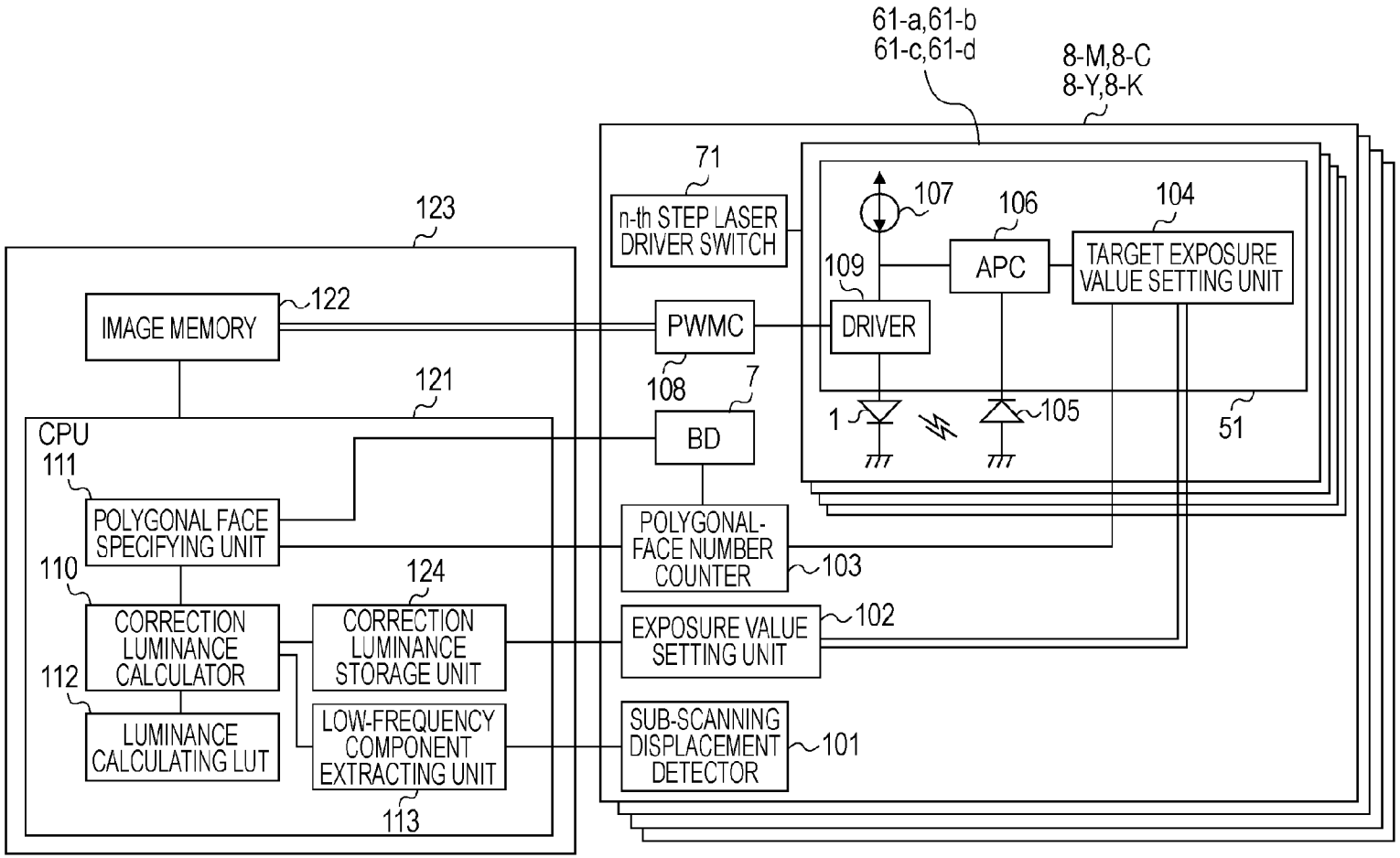
FIG. 1 is a block diagram of hardware and functions of an image forming apparatus.

FIG. 1 is a block diagram of a printer according to an embodiment that forms images on an image bearing member by deflecting multi-laser beams with a rotatable polygonal mirror and that is capable of suppressing the unevenness of color density due to exposure amount changes in a sub-scanning direction. These blocks are connected together on conditions capable of reading and writing information with each other.

A printer engine controller 123 feeds data produced by a controller (not shown) to an exposure unit 8 with predetermined timing based on an image memory for printing images by drawing them with laser. Referring to FIG. 1, a CPU 121 in the engine controller 123 controls inside the engine, including the exposing timing control, the paper feed control (not shown), the conveying drive control (not shown), the high-voltage control (not shown), and the fixing control (not shown).

The exposure amount refers to a time-integrated value of laser irradiation on an exposed surface, and an adjustment method of the exposure amount includes a PWM (pulse width modulation) system for adjusting the exposure time and a luminance modulation system for adjusting the luminance. A luminance modulation system and PWM system may be incorporated in the present invention. Alternatively, a hybrid modulation system, which is the combination of a luminance modulation and a PWM system, may be incorporated in the present invention.

Figure 22A:
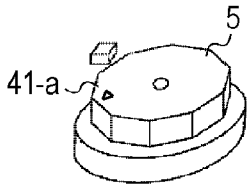
FIGS. 22A and 22B are drawings for illustrating a method for specifying polygonal faces.

A beam detector (referred to as a BD below) 7 within the exposure unit 8 specifies the writing position in a main-scanning direction every time when the polygonal face is changed so as to synchronize the main-scanning. Since the BD 7 feeds one signal every time when the polygonal face is changed, a periodic signal of the number of polygonal faces can be produced in combination with a polygonal-face number counter 103. A polygonal-face specifying unit 111 may be configured without using an index mark and a reflection sensor unlike in FIG. 22A. Exemplary details of the polygonal-face specifying unit 111 are provided below. A sub-scanning displacement amount detector 101 measures the sub-scanning displacement amount for every face in an assembling process in advance and stores it in an EEPROM (electronically erasable and programmable read only memory). Although the EEPROM is not shown, it may be contained, for example, in the sub-scanning displacement amount detector 101. For example, in FIGS. 11A and 15B, which are described below, the sub-scanning displacement amount may be stored in the sub-scanning displacement amount detector 101. In the tandem-type color printer, the exposure unit 8 is composed of four-color units of a unit 8-C for cyan, a unit 8-Y for yellow, a unit 8-M for magenta, and a unit 8-K for black.

The sub-scanning displacement amount is herein described in detail with reference to FIG. 11A. FIG. 11A shows an example of the exposure amount correction setting in the sub-scanning direction using an optical system (2400 dpi, four-beams, the 12-face polygon, and the spot diameter 50 μm). This is an example corresponding to the displacement amount in the sub-scanning direction listed in FIG. 11A for every neighboring beam of the four beams and every polygonal face on the exposed surface. In FIG. 11A, the value of D1 of the first face is −0.15 μm, for example.

The setting shown in FIG. 11A may be stored in the EEPROM by measuring the sub-scanning displacement amount for every face of the rotatable polygonal mirror in the assembling process of the image forming apparatus in advance. Alternatively, the results measured by the printer may be stored in the EEPROM.

Figure 12A:
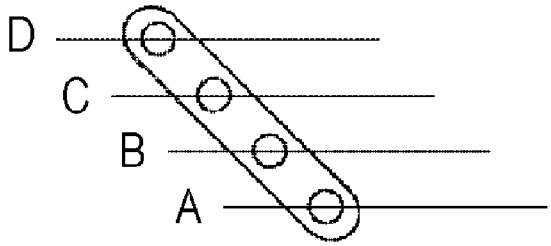
FIGS. 12A and 12B are drawings showing multi laser beams.
Figure 12B:
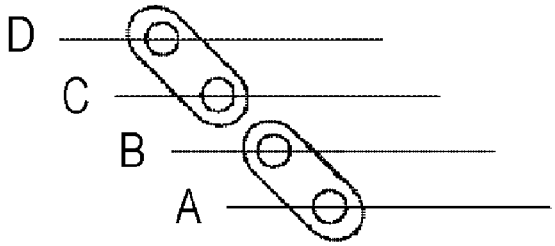

The values in FIG. 11A show the displacement amount from an ideal position: zero is the ideal position; with increasing plus-value, the position approaches the next line; and with increasing minus-value, the position approaches the previous line. From FIG. 11A, it is understood that not only the displacement every polygonal face but also the sub-scanning beam position of every neighboring beam of the four beams are displaced. This is because two 2-beam inexpensive laser units shown in FIG. 12B are combined into an expensive 4-beam laser unit shown in FIG. 12A. Namely, when a plurality of 2-beam inexpensive laser units are combined together as shown in FIG. 12B, unless optical adjustment has been finely made, the sub-scanning beam position may also be displaced between neighboring beams. According to the present invention, the displacement can be suitably corrected even when a plurality of the 2-beam inexpensive laser units are combined together.

Referring again to the description of FIG. 1, a correction luminance calculator 110 calculates the information about the exposure amount correction on the basis of the spot diameter, the resolution, the number of lines N in the period to circle around the polygon N (N=n*1 when the polygon face number is n and the number of beams for simultaneous writing is 1), and the sub-scanning displacement amount of every polygonal face. This calculated result (luminance correction factor x(N)) is stored in a correction luminance storage unit 124. The x(1) means the luminance correction factor on the 1st face and at the first line, and the x(4) means the luminance correction factor on the 2nd face and at the first line, for example. An example of the calculated result is shown in FIGS. 11A and 11B, FIGS. 14A and 14B, and FIG. 18 which are described below in detail. In the luminance calculation, an n-dimensional linear equation is formed so as to calculate an optimal solution with reference to a luminance calculating LUT 112, and then, correction is made in accordance with human visibility. The luminance calculation and correction are described in detail below.

The luminance calculating LUT 112, as shown in FIG. 4, is a table showing a cumulative distribution of a Gaussian density distribution having a mean of zero (0) and standard deviation of σ, with locations on the cumulative distribution being given in the table in units of the standard deviation σ relative to the mean (0) of the density distribution. The Gaussian density distribution and its cumulative distribution (normalized area under the density distribution) are calculated in advance and stored in an ROM (read only memory). For example, the function $f(y)=1/\exp((y^2))$ may be used for the Gaussian density distribution. The cumulative distribution S(y) can then be determined by integrating f( ) from −∞ to y. Normalization is taken so that in the limit S(y) goes to 1 as y goes to +∞. For calculating a probability distribution (area) of some region, this can be easily done by subtracting the cumulative distribution (area) S(y) in smaller y from that S(y) in larger y. Values for S can be conveniently determined, for example, from FIG. 4, or alternatively from a table of the Gaussian cumulative distribution, or alternatively by using a statistical calculator. For example, for easily calculating a proportion of the exposure amount of a spot diameter, the smaller y may be taken as −SQRT(2) (approximately −1.414), and the larger y may be taken as +SQRT(2) (approximately +1.414), which yields:

$$\begin{aligned} Sspot &= S(SQRT(2)) - S(-SQRT(2)) \\ &= 0.9213 - 0.0787 \\ &= 0.8426 \end{aligned}$$

For simplicity, it is convenient to suppress the parameter y and simply express locations in units of the standard deviation σ, for example, simply as σ=−SQRT(2) to σ=+SQRT(2), where it is understood that σ=−SQRT(2) and σ=+SQRT(2) specify locations relative to the mean (0) of the Gaussian density distribution in units of the standard deviation σ.

In FIG. 4, the resolving power is shown in increments of 0.1; however, in practice, it is necessary to store the resolving power corresponding to the spot diameter and the sub-scanning displacement amount resolving power. For example, when the spot diameter is 50 μm and the resolution of the sub-scanning displacement amount is about 0.1 μm, the resolution of the standard deviation a is shown in increments of 0.006. An exposure amount setting unit 102 reads out a luminance correction factor x(N) stored in a correction luminance storage unit so as to set the luminance for every polygonal face based on the luminance calculated by the correction luminance calculator 110.

Referring again to the description of FIG. 1, a low-frequency component extracting unit 113 is for obtaining the total exposure amount change in the low-frequency component, from which the exposure amount change in the high-frequency component of the total exposure amount change in the sub-scanning direction is removed or suppressed. The low-frequency component extracting unit 113 has functions shown FIGS. 7A and 7B or alternatively FIGS. 16A to 16C which are described later. The output range of a laser unit 61 can be reduced by the extraction of the low-frequency component. The target exposure amount setting unit 104 sets a target exposure amount of the practical laser emission corresponding to the polygonal face on the basis of the polygonal face information counted by a polygonal-face number counter 103 and the exposure amount set by the exposure amount setting unit 102. For example, the target exposure amount setting unit 104 can be configured of a D/A converter (digital to analog converter). An APC (automated power control) 106 maintains the power of the exposure amount produced by laser 1 at constant level relative to the monitor light power of a laser light power monitoring photo-diode 105. A pulse width modulation controller PWMC 108 converts the image information sent from an image memory 122 with predetermined timing into the PWM signal corresponding to the multi-level density. The PWM signal is supplied to a driver 109. Responsive to the PWM signal, the driver 109 controls laser exposure of light emitted by the laser 1. An electric current supply 107 provides power for the laser 1. In the above description, reference numerals 104, 106, 107, and 109 together denote a laser driver with a luminance modulating function, which, for example, may be provided in the form of an integrated circuit (IC).

The laser driver 51, the laser 1, the laser light power monitoring photo-diode 105 constitute the laser unit 61. In a multi-laser beam unit, a plurality of the laser units 61 are arranged; according to the embodiment, four laser units 61 are provided, and the laser unit 61 is composed of laser units 61-*a*, 61-*b*, 61-*c*, and 61-*d*. The multi-laser beam unit includes an n-th step laser driver switch 71 for applying pulse width modulation using the PWMC 108 to the laser unit 61 driven in practice. The PWM 108 is connected to a plurality of laser units so as to be able to simultaneously drive the plurality of laser units. The correction luminance storage unit 124 stores a luminance correction factor x(N) of each line for every face of the rotatable polygon mirror, which is luminance information. In the four-color laser unit 61, the x(N) for (N×4) is stored in the correction luminance storage unit 124. The exposure amount setting unit 102 drives the laser unit 61 based on the luminance correction factor x(N) read out of the correction luminance storage unit 124.

(Polygonal Face Specifying Method)

Figures 2, 3:
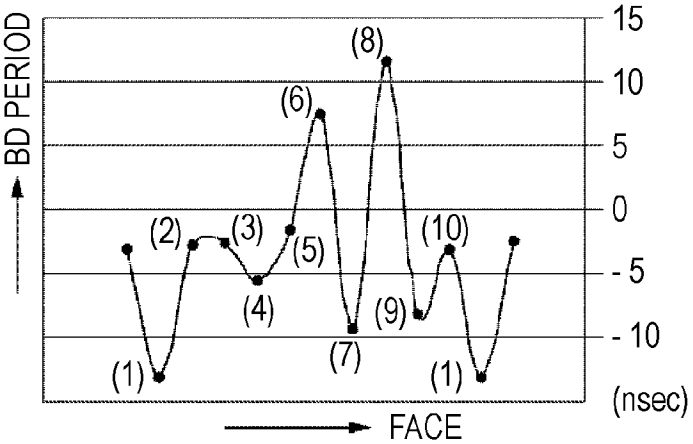
FIG. 2 is an explanatory view for illustrating one example of a method for specifying polygonal faces.
FIG. 3 is an explanatory table for illustrating values relating with the displacement amount in the method for specifying polygonal faces.
Figure 22B:
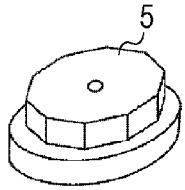
Figure 23A:
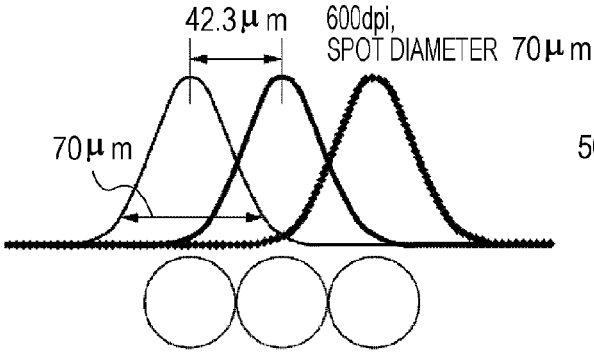
FIGS. 23A and 23B are drawings for illustrating the relationship between the spot diameters and resolving power (resolution).
Figure 23B:
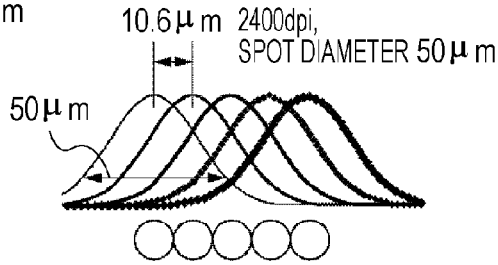

In succession; a specifying method of a polygonal face by a polygonal face specifying unit 111 is described with reference to FIGS. 2 and 3. FIG. 2 is a graph of a BD period for each polygonal face of 10 polygonal faces, in which polygonal face is plotted in abscissa and BD period in ordinate. From this graph, the periodicity of the polygonal-face number period (every 10 faces, herein) is understood. The fluctuations in the BD time every polygonal face are due to mechanical accuracies of the face. The period of the number of polygonal faces contains the information inherent in the polygon, although it has long periodic jitter due to the motor control. For specifying the polygonal face without a mark shown in FIG. 22B, the feature of periodic time fluctuations of the period of the number of polygonal faces for each polygonal face is used. The long periodic jitter is superposed on the period every polygonal face, so that the whole BD periodic time fluctuates. The reasons of the long periodic jitter include changes in temperature and changes in voltage, so that the BD period always includes the long periodic fluctuations. Furthermore, fluctuations with a period to circle around the polygon due to the polygonal face accuracies are superposed on these. Thereby, the feature information for each polygonal face can be rather easily extracted by evaluating characteristics with the BD time difference for each polygonal face. According to the embodiment, by using the difference in the BD period between polygonal one face and previous face, the feature of the polygonal-face period can be extracted because the long periodic jitter is cancelled. The displacement amount may be stored together with the difference value; however, the difference values are integrated into an integral difference herein, and feature information of the BD period is extracted by subtracting the average value of the integral difference. The reason of subtracting the average value is for removing an offset of the integral difference because there is the offset equivalent to the average value of the integral difference. In this example, the minimum value of "(integral difference)−(average)" is −10.5, which corresponds to the 1st face polygon ((1)) in FIGS. 3 and 2. If there are a plurality of candidates of the minimum value in the calculated results of "(integral difference)−(average)", since the values of "(integral difference)−(average)" are stored in the LUT as feature information, then one may be selected. In the LUT, the absolute displacement amount for each polygonal face measured in the process is stored together with the values of (integral difference)−(average) as the feature information of the BD period. By extracting the feature information, the 1st face polygon ((1)) can be specified and by using a polygonal-face number counter (a decimal counter for 10 faces), a certain polygonal face can be specified. The correspondence of the specified polygonal face may be determined using the absolute displacement amounts stored in the LUT. In FIG. 3, the method has been described for storing the absolute displacement amount together with "(integral difference)−(average)" as shown by symbol ○. Alternatively, as shown by symbol Δ, the displacement amount in the sub-scanning direction relative to the 1st face polygon ((1)) as a reference may also be stored together with the difference. This is because in a scanning exposure system for successively scanning by switching the polygonal face, the absolute position is not so meaningful. The displacement amount relative to the adjacent face may be stored. The example in that the feature information is stored as an analog time has be described; however, various modifications may be made; for example, the feature information may also be stored with codes such as 11 when the difference is minus; 00 when the difference is plus; and 01 when the difference is not changed. Namely, according to the embodiment, by storing the sub-scanning displacement amount together with the feature information due to the BD period for every polygonal face, the correspondence of the polygonal face with the sub-scanning displacement amount can be made. The present embodiment is not limited to the specifying method of the polygonal face described above, so that a specifying method of a polygonal face using the mark 41-*a* shown in FIG. 22A may also be adopted.

(Displacement Amount in Sub-scanning Direction and Exposure Amount Distribution in View of Gaussian Distribution)

The exposure amount in the sub-scanning direction is changed due to a plurality of the main-scanning lines being continuously exposed during scanning of a presently scanned main-scanning line. A main-scanning line may thus be exposed both when it is scanned (when it may alternatively be referred to as a main-scanning noticed line) and also one or more times during scanning of neighboring or near neighboring main-scanning lines. Thus, a plurality of the main-scanning lines may be continuously exposed over a plurality of scannings corresponding to a respective plurality of main scanning noticed lines. This respective plurality of main-scanning noticed lines may include, for example, a presently scanned main-scanning line and the two main-scanning lines (next lines) depicted immediately following the presently scanned main-scanning line. They may also include, for example, the two main-scanning lines (previous lines) depicted immediately preceding the presently scanned main-scanning line. FIGS. 5A and 5B show the exposure amount calculation for each scanning line under the conditions of 1200 dpi (sub-scanning pitch 21.2 μm), the spot diameter 70 μm, and no sub-scanning displacement. Reference characters S2*m*, S1*m*, SO, S1*p*, and S2*p* represent the exposure amounts of respective scanning lines. In particular, SO corresponds to the presently scanned main-scanning line, S1*m* and S2*m* correspond to the main-scanning lines that precede the presently scanned main-scanning line by one and two main-scanning lines respectively; and S1*p* and S2*p* correspond to the main-scanning lines that follow the presently scanned main-scanning line by one and two main-scanning lines respectively. FIG. 5A is a distribution diagram and FIG. 5B shows calculated results. When the exposure amount is expressed as a Gaussian-distribution function $f(\sigma)=1/\exp((\sigma^2))$, since the spot diameter is a region where the luminance is $1/e^2$ of the center luminance, σ corresponds to between −SQRT (2) and +SQRT (2). The standard deviation σ of the sub-scanning pitch M (μm) at the spot diameter N (μm) is obtained from M/N×SQRT (2). For example, when the standard deviation σ indicates the spot diameter is 70 μm in correspondence to between −SQRT (2) and +SQRT (2), since the sub-scanning pitch is 21.2 μm at 1200 dpi, the exposure amount may be calculated from σ=−0.4276 to σ=0.4276:

$$S0 = S(0.4276) - S(-0.4276) = 0.3311.$$

Similarly:

$$S1m=S(-0.4276)-S(-1.2828)=0.2347$$

$$S1p=S(1.2828)-S(0.4276)=0.2347$$

$$S2m=S(-1.2828)-S(-2.138)=0.0835$$

$$S2p=S(2.138)-S(1.2828)=0.0835.$$

From the above, it is understood that under the conditions of 1200 dpi (sub-scanning pitch 21.2 μm) and the spot diameter 70 μm, the presently scanned main-scanning line exposes about 23% of the adjacent main-scanning lines and about 8% of the main-scanning lines (other than the presently scanned main-scanning line) adjacent thereto.

On the other hand, FIGS. 6A and 6B show calculated results of the exposure amount with a displacement of −2.0 μm in the sub-scanning direction. FIG. 6A is a distribution diagram and FIG. 6B shows calculated results. The conditions, such as 1200 dpi, are the same as described with reference to FIGS. 5A and 5B. Since 2.0 μm herein corresponds to σ=2*2*SQRT(2)/70=0.0808:

$$S0 = S(0.4276 + 0.0808) - S(-0.4276 + 0.0808) = 0.3301.$$

Similarly:

$$S1m=S(-0.3468)-S(-1.2020)=0.2497$$

$$S1p=S(1.3636)-S(0.5084)=0.2119$$

$$S2m=S(-1.2020)-S(-2.057)=0.0949$$

$$S2p=S(2.2188)-S(1.3636)=0.0731.$$

Since the sub-scanning position is displaced to the minus side, it is understood that the exposure amount is shifted to the previous line.

In such a manner, when the spot diameter, the resolution, and the sub-scanning displacement amount are figured out, using the table of the standard deviation and the probability distribution (area) shown in FIG. 4, the exposure effect can be added from a plurality of the main-scanning lines continuously exposed by a plurality of the main-scanning noticed lines. Also, not only the main-scanning lines continuously exposed by a plurality of the presently depicted (noticed) main-scanning lines, but also the exposure effect can be added from the main-scanning lines continuously exposed in the previous. Namely, it is easy to calculate the exposure amount of the main-scanning lines that are next and previous, and further next and further previous, relative to the presently scanned (noticed) main-scanning lines. Then, if the spot diameter, the resolution, and the sub-scanning displacement amount are figured out, from the exposure amount of the main-scanning lines that are next and previous, and that are further next and further previous, relative to the presently scanned (noticed) main-scanning lines, the total exposure amount can be precisely calculated for each sub-scanning pitch (10.6 μm at 2400 dpi, for example).

(Human Visibility)

Figure 7A:
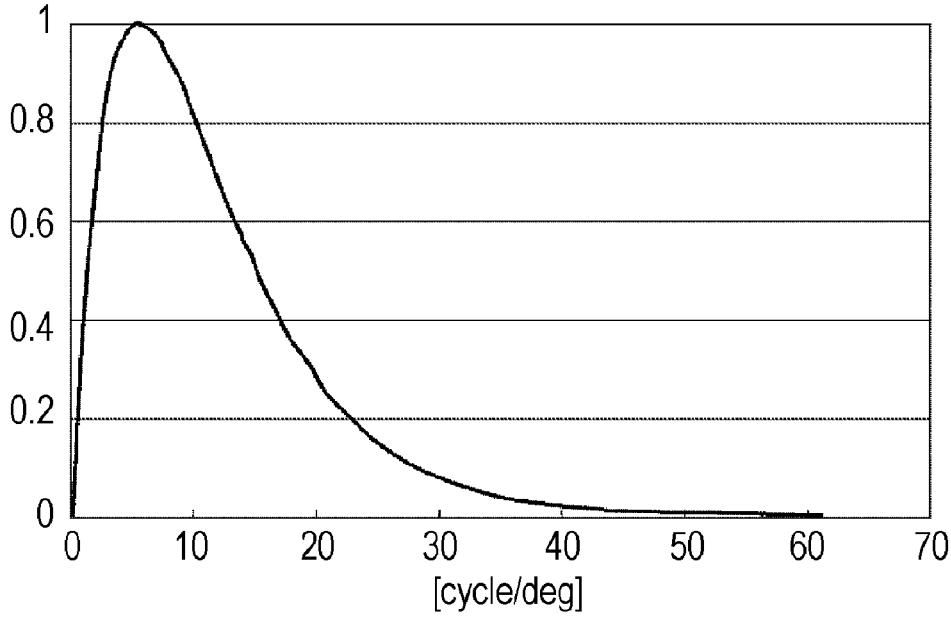
FIGS. 7A and 7B are drawings for illustrating human visibility.
Figure 7B:
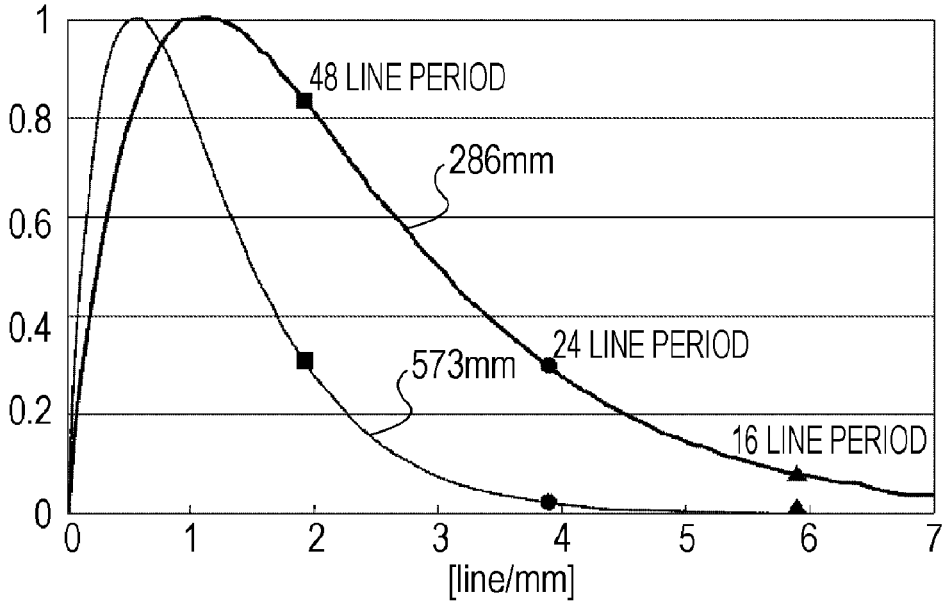

FIGS. 7A and 7B show characteristics of human visibility. FIG. 7A is a normalized graph in that the number of concentration-difference streaks per view angle is plotted in abscissa and the relative value of visibility (maximum is 1.0) is plotted in ordinate (one concentration-difference streak is counted out as one). Namely, it is understood that the human visibility is the maximum in several concentration-difference streaks per view angle 1° while the visibility is reduced when the spatial frequency is lower or higher than that. Then, FIG. 7B shows the graph of the line pitch versus visibility characteristics in the practical printing.

FIG. 7B is also a normalized graph in that the line pitch (line/mm) is plotted in abscissa and the relative value of visibility (maximum is 1.0) is plotted in ordinate (two black and white patterns are counted out as one (line/mm), and at n (line/mm), the practical resolution requires 2*n(line/mm)). However, since the view angle changes depending on the distance between human eyes and printed images even in the same line pitch on the printed images, examples are shown with distances 573 mm and 286 mm to the printed images.

Figure 8:
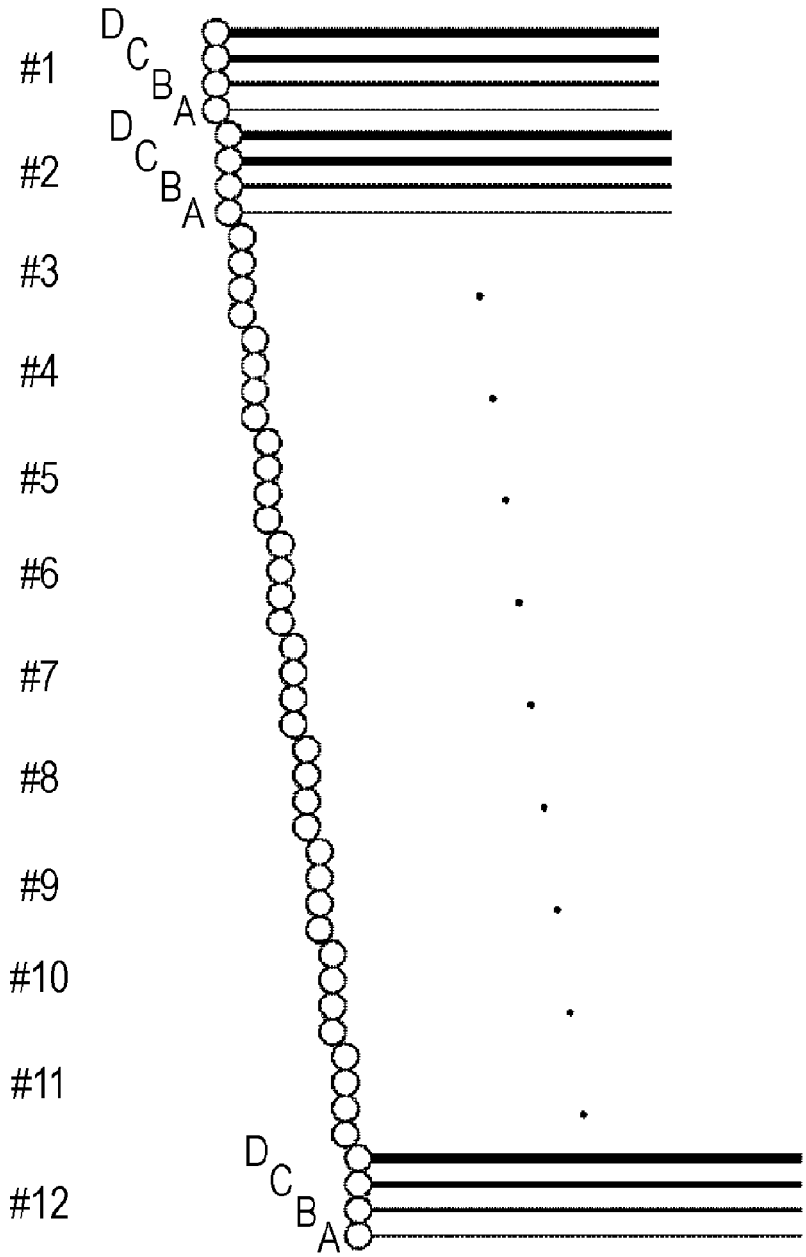
FIG. 8 is a drawing for schematically showing drawing situations with a 4-beam simultaneous exposure laser scanner (2400 dpi, 12 polygonal faces).

On the visibility characteristic curved line, the relative visibility values at 4×12=48 line period, ½ period thereof, and ⅓ period thereof are plotted by assuming the depiction with a laser scanner (2400 dpi, 12 faces polygon, and four-beam simultaneous exposing) as shown in FIG. 8. A human views printed images generally by separating them by about 30 cm, so that the characteristic curved line at 286 mm may be used for determination. From this, it is understood that at the 48 line period to circle around the polygon, the visibility is high so as to be sensitive to the change in concentration difference. With increasing spatial frequency, such as the 24 line period, which is twice as fast as the 48 line period to circle around the polygon, and the 16 line period which is three times, the visibility is decreased, and if the spatial frequency is increased larger than the 16 line period, the visibility is almost eliminated. From this, it may also be sufficient to take periods until the 16 line period into account. At the spatial frequencies higher than the 16 line period (25.4 mm/2400*16=0.166 mm pitch (6 line/mm)), the resolution of human eyes is reduced so as to become difficult to discriminate differences, so that it is not necessary to finely adjust the concentration difference due to the sub-scanning displacement. However, at 2400 dpi, the concentration difference of the corrected 16 line period may be yet discriminated, so that it is understood that it is necessary to correct the concentration difference due to the sub-scanning displacement.

This suggests that the low-pass filter processing (the moving averaging process of the exposure amount every 4 lines, for example) at spatial frequencies sufficiently higher than the 16 line period is not substantially noticed. In other words, changes in exposure amount at least with a maximal frequency component do not need to be corrected. When the changes in exposure amount with low frequency components (low-frequency exposure amount changes), among the exposure amount changes in the sub-scanning direction, are maintained substantially constant, the color density unevenness can be corrected efficiently. The expression "substantially constant" means that the changes in exposure amount with low frequency components are maintained about constant to the extent in which the color density unevenness is inconspicuous to a user. Although the changes in exposure amount with low frequency components may be obviously maintained perfectly constant, for suppressing the color density unevenness conspicuous to a user, the changes are not necessarily maintained perfectly constant.

FIGS. 9A to 9C show a block diagram and frequency characteristics of an FIR (finite impulse response) filter for 4-line moving averaging according to the embodiment. Although the present invention is not obviously limited to the 4-line moving average, the description below adopts the 4-line moving average. FIG. 9A is a block diagram of the filter, which may be configured using a dedicated circuit or by software programming. The reference character $Z^{-1}$ denotes a delay line element. The 4-line moving average is to sum up past four pieces of sequentially inputted data so as to average them with division by 4. FIG. 9B shows the FIR (the gain and phase of filter frequency characteristics) for 4-line moving averaging; and FIG. 9C is a table of the gain. This table shows that in the FIR filter for 4-line moving averaging, at 4-line period, i.e., 11.8 (line/mm), the gain attenuates to 0 (−∞ dB) so as to effectively suppress the concentration difference with the period of the number of lines. By the FIR filter shown in FIGS. 9A to 9C, it is possible to extract the exposure amount changes in the low-frequency component from which the exposure amount changes in the high-frequency component are removed or suppressed.

With the low-pass filter shown in FIGS. 9A to 9C, the adjusting range of the light quantity can be reduced. Also, in accordance with this, the resolution of a laser driver with a luminance modulating function 51 (laser unit) can be widely reduced; for example, when 12 bits have been conventionally required, the resolution can be reduced to 8 bits, alternatively, from 10 bits to 6 bits. Thereby, the cost of the laser unit 61 can be reduced.

(Exposure Amount Correction Process)

Figure 13:
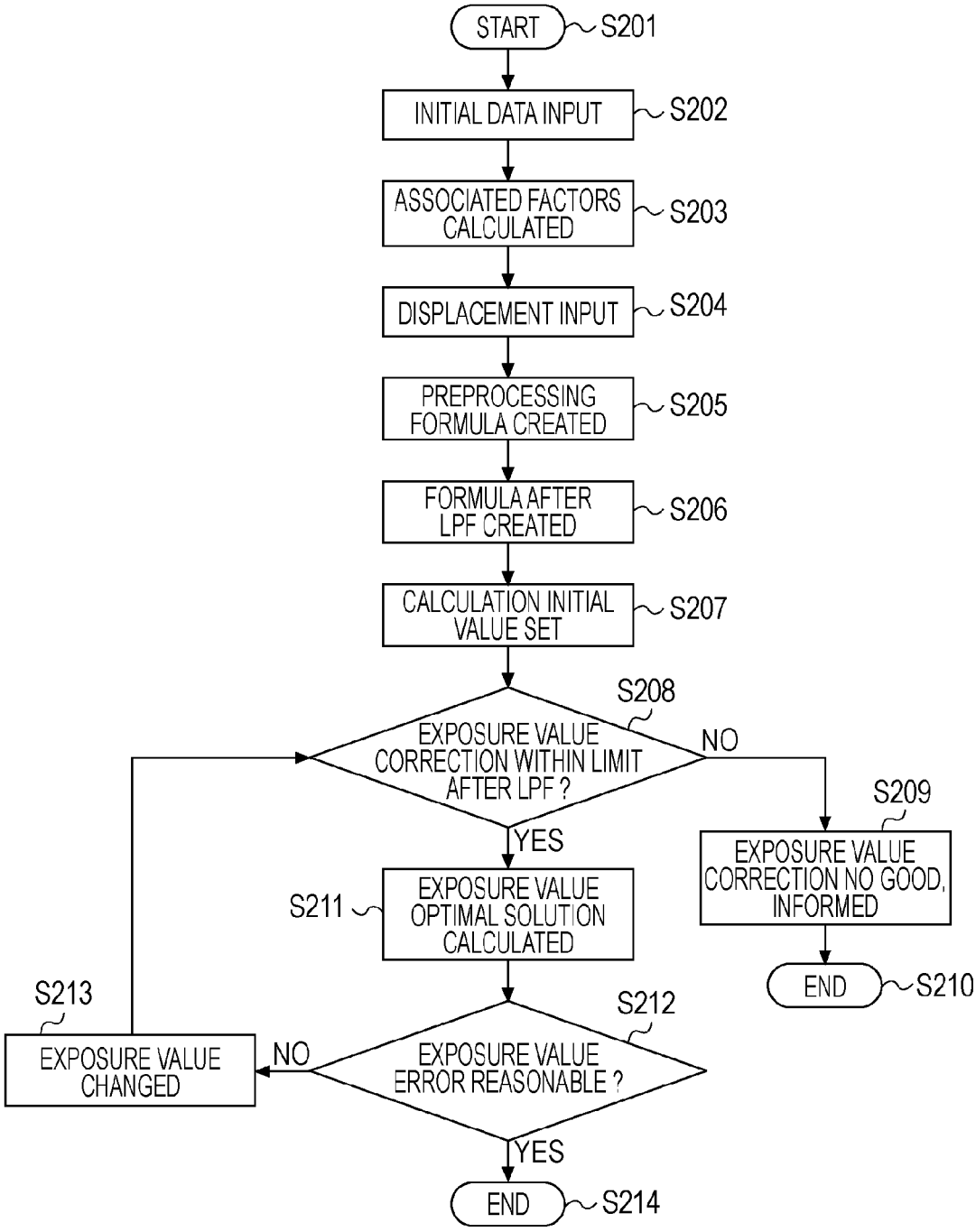
FIG. 13 is a flowchart of the process for setting the luminance value.

FIG. 13 is a flowchart of the present embodiment, in which the program is executed by a central processing unit (CPU) 121 of an engine controller 123 or another CPU provided outside, alternatively, by these CPUs in cooperation with other hardware. With reference to this flowchart, a calculation method is described that calculates the luminance (the exposure amount) for each polygonal face and for each of a plurality of beams from the sub-scanning displacement amount for each polygonal face and for each of a plurality of beams.

Referring to FIG. 13, at S201, the flow is started; and at S202, the initial data, such as the spot diameter Sp (μm), the resolution P (dpi), the number of lines with the period to circle around the polygon N (line), the standard luminance L (mA), the luminance correction factor limit value Kl (fold), the luminance amount reasonable error determination index Ke, and the luminance consideration index Ks, are input. A method for calculating the number of lines with the period to circle around the polygon N (line) is described below in detail using 4-beam laser and a 12-face polygon.

According to the embodiment:

Sp=50 (μm)
P=2400 (dpi)
L=4 (beams)
N=12 (faces)
N=4 (beams)*12 (faces)=48 (Line)
Kl=1.3 (−fold)
Ke=0.02
Ks=2.0 wherein, if the luminance correction factor exceeds 1.3-fold thereof or 1/Kl=0.77, the luminance correction factor limit value Kl determines that the correction luminance is not reasonable so as to stop processing as exception handling or to attach the correction value to the limit value. If the fluctuation band of the luminance for each sub-scanning pitch is calculated to be within Ke=0.02 (2%), the luminance reasonable error determination index Ke determines the correction factor to be reasonable so as to complete the process. For suppressing the luminance fluctuation, the value of the luminance reasonable error determination index Ke may be reduced. The luminance consideration index Ks is for allowing the standard deviation σ of the exposure vale to be within $|\sigma| \leqq 2.0$, and in this case, the spot diameter is allowed to be within SQRT (2)=1.414 fold.

At S203, a correction luminance calculator 110 manipulates the calculation of associated factors. Namely, it calculates the line allowance of the exposure amount, i.e., to what number of lines for the exposure amount, from the spot diameter, the luminance consideration index, and the resolution. Since the allowance of the exposure amount is 50*1.414=70.71 (μm), and the sub-scanning pitch is 25.4/2400*1000=10.6 (μm), z=roundup (70.71/10.6,0)=roundup (6.67,0)=7, so that it is understood that 7 lines are allowed. That is, it is understood that the exposure amount may be calculated in consideration of the lines that are next and previous, that are further next and further previous, and that are still further next and still further previous, each relative to the main-scanning noticed line.

At S204, the displacement amount is inputted by a sub-scanning displacement amount detector 101 shown in FIG. 1. In the number of lines with a period to circle around the polygon N (line), N pieces of the displacement amount data are inputted. The displacement amount for each line is inputted as such a manner of lv (1), lv (2) . . . , lv (48)(μm). An example of inputted data is shown in below-mentioned FIG. 11A.

S205 is the preprocessing of formula creation executed by the correction luminance calculator 110 shown in FIG. 1. The luminance correction factor for each line is x(N); the total exposure amount of each line is SumS(N); and the present line exposure amount due to the depiction by N lines is S0(N), in which the total exposure amount SumS(N) and the exposure amount S0(N) are the same as the variables described with reference to FIGS. 5A to 6B. Also, the exposure amount of the previous line is S1*m*(N); the exposure amount of the further previous line is S2*m*(N); the exposure amount on the still further previous line is S3*m*(N); the exposure amount of the next line is S1*p*(N); the exposure amount of the second next line is S2*p*(N); and the exposure amount of the third next line is S3*p*(N). The variables herein are also the same as those described with reference to FIGS. 5A to 6B. Then, the 48 linear equations are formed as follows:

$$\mathrm{Sum}S(1)=x(46)*S3m(46)+x(47)*S2m(47)+x(48)*S1m(48)+x(1)*S0(1)+x(2)*S1p(2)+x(3)*S2p(3)+x(4)*S3p(4)$$ . . . the equation of Sum*S* of the first line, $$\mathrm{Sum}S(2)=x(47)*S3m(47)+x(48)*S2m(48)+x(1)*S1m(1)+x(2)*S0(2)+x(3)*S1p(3)+x(4)*S2p(4)+x(5)*S3p(5)$$ . . . the equation of Sum*S* of the second line, $$\mathrm{Sum}S(3)=x(48)*S3m(48)+x(1)*S2m(1)+x(2)*S1m(2)+x(3)*S0(3)+x(4)*S1p(4)+x(5)*S2p(5)+x(6)*S3p(6)$$ . . . the equation of Sum*S* of the third line,

. . . .

$$\mathrm{Sum}S(48)=x(45)*S3m(45)+x(46)*S2m(46)+x(47)*S1m(47)+x(48)*S0(48)+x(1)*S1p(1)+x(2)*S2p(2)+x(3)*S3p(3)$$ . . . the equation of Sum*S* of the $48^{th}$ line.

Figure 10A:
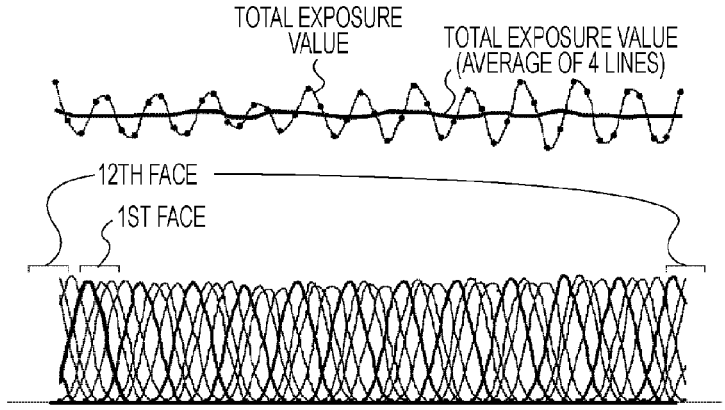
FIGS. 10A and 10B are drawings for illustrating the relationship between the total exposure amount and the laser beam output.

In these equations, the exposure amount of 7*48 pieces in S3*m*(N), S2*m*(N), S1*m*(N), S0(N), S1*p*(N), S2*p*(N), and S3*p*(N) can be calculated from the relationship between the spot diameter, the resolution, and the displacement amount. By connecting SumS1) to (48) with lines or by approximating them, the waves of the total exposure amount can be obtained as shown in FIG. 10A. In practice, the low-frequency component unevenness of the total exposure amount, which is sensitive to human visibility and contained in the waves of the total exposure amount shown in FIG. 10A, is exhibited as the color density unevenness (so-called banding). On the other hand, the waves of the high-frequency component, which are shown as smaller waves in the drawing, are exhibited as the exposure amount unevenness being insensitive to the human visibility. According to the embodiment, the exposure amount is corrected so as to suppress the exposure amount change in the low-frequency component of the exposure amount change in the sub-scanning direction, from which the exposure amount change in the high-frequency component is removed or suppressed. More specifically, the color density unevenness can be effectively suppressed/controlled by extracting the total exposure amount unevenness in the low-frequency component so as to control the exposure substantially constant.

According to the first embodiment, the process is executed by assuming the luminance for each face to be the same/substantially the same, as follows:

$$x(1)=x(2)=x(3)=x(4),$$

$$x(5)=x(6)=x(7)=x(8),$$

. . .

$$x(45)=x(46)=x(47)=x(48).$$

In addition, the luminance of the multi-laser beams is not necessarily to be the same or substantially the same for each face, so that the luminance of each laser beam may also be individually adjusted. In this case, the 48 linear equation is used assuming that x(1) to x(48) are different.

Then, at S206, a new equation is led by applying LPFs to the above equation by a low-frequency component extracting unit 113 shown in FIG. 1. When the 4-line moving averaged total exposure amount shown in FIGS. 9A to 9C is to be LPFS(N), 48 linear equations are formed as follows:

$$\mathrm{LPFS}(1)=(\mathrm{Sum}S(46)+\mathrm{Sum}S(47)+\mathrm{Sum}S(48)+\mathrm{Sum}S(1))/4,$$

LPFS(2)=(Sum*S*(47)+Sum*S*(48)+Sum*S*(1)+Sum*S*(2))/4,

. . .

LPFS(48)=(Sum*S*(45)+Sum*S*(46)+Sum*S*(47)+Sum*S*(48))/4.

By connecting LPFS(1) to (48) with lines or by approximating them, the line of the total exposure amount (averaging of 4 lines) can be obtained as shown in FIG. 10A. The amplitude of the high-frequency component of the exposure amount changes after correction shown in FIG. 10A is larger than that of the low-frequency component of the exposure amount changes after correction. Occasionally, it is increased by a factor of n (n is an integer of 2 or more). This is because the amplitude of the high-frequency component of the exposure amount changes before correction is not a direct control target for suppressing the color density unevenness due to changes in the principal scanning line interval of the laser beam in the photosensitive drum 14.

Furthermore, when the index Er for determining the completion of the optimal solution calculation is to be Er=Max(LPFS(1:48))−min(LPFS(1:48)), the equation is formed for substituting the difference between the maximum exposure amount (moving averaged) for each sub-scanning pitch and the minimum exposure amount (moving averaged) for the index Er.

At S207, the calculation initial value is set by the correction luminance calculator 110 shown in FIG. 1. For example, 1.0 may also be wholly substituted for x(1), x(2), x(3), . . . x(48). Alternatively, from the relative displacement amount, at the large space, 1.05 may also be set; at the small space, 0.95 may also be set. Since the initial value setting affects the processing time for calculating an optimal value in the following processing, it is useful to set a reasonable value, such as those described above. The relative displacement amount relates not only to the front adjacent line or rear adjacent line but also to the front and rear adjacent lines. For example, when the position relative to the front is 1.10-fold of the sub-scanning pitch (11.7 μm) and that relative to the rear is 0.98-fold of the sub-scanning pitch (10.4 μm), the pitch to the front line is large while that relative to the rear line is small. In this case, the determination may also be made by comparing the root sum square thereof with SQRT(2)=1.414. Since SQRT $(1.1^2+0.98^2)$=1.473>SQRT(2) in this case, the pitch may be determined to be larger. The root sum square shown above is useful for setting an initial value that reduces the processing time for calculating the optimal value.

In succession, at S208, it is determined whether the luminance correction is within the optimal range. The processing of this S208 and below-mentioned S209 to S213 is performed by the correction luminance calculator 110 shown in FIG. 1.

At S211 to S214, it is determined whether the luminance is within the optimal range, that is 0.77<x(N)<1.3, as a result of the optimal solution search. When at least one luminance correction magnification x(N) exceeds K1 or 1/Ke, the process at S208 is determined to be "No" so as to proceed to S209. At S209, the process informs that there will be no luminance correction so as to finish processing at S209. As another example, when the luminance correction magnification exceeds K1 or 1/Ke, the optimal solution search may also be continued by attaching the correction value to K1 or 1/Ke. When at least one luminance correction magnification x(N) does not exceed K1 or 1/Ke, the process at S208 is determined to be "Yes" so as to proceed to S211.

At S211, an optimal solution of x(1) to x(48) is searched together with at S213. For example, upon searching max (LPFS(1:48)), if max(LPFS(1:48))=LPFS(i), x(i), which increases LPFS(i) representatively, is multiplied by 0.99. Also, upon searching min(LPFS(1:48)), if min(LPFS(1:48))=LPFS(i), x(i), which decreases LPFS(i) representatively, is multiplied by 1.01 for searching the optimal value.

On the basis of the obtained values, the luminance information is set about the exposure amount correction (luminance correction) shown in FIG. 11B. As shown in FIG. 11B, the luminance information is stored in a correction luminance storage unit 124 for each face as well as for each beam of the multi-laser beams. The engine controller 123 drives the laser unit 61 based on the optimal solution of x(1) to x(48). In the example shown in FIG. 11B, the whole information is shown for determining the laser beam luminance for each polygonal face as well as for each beam of the multi-laser beams; alternatively, the luminance may also be calculated at each real time on demand. Various shapes of the value specifying the luminance, such as the difference to the previous value, may be assumed.

At S212, it is determined whether the luminance is reasonable. For example, by calculating Er=max (LPFS(1:48))−min (LPFS(1:48)), Er−1<Ke=0.02 is determined. If Er−1<0.02, the process is determined to be "Yes" so as to finish processing at S214. If Er−1>0.02, the process is determined to be "No" so as to proceed to S213. The process S213 changes the luminance in practice for searching the optimal solution of the previous process S211. From S208, by repeating S211, S212, and S213, the optimal solution can be searched.

In the flowchart of FIG. 13, the process of each step is executed by the printer shown in FIG. 1; however, the present invention is not limited to this, so that the process of each step of FIG. 13 may also be executed in advance during assembling of the printer. Alternatively, during the assembling, the process may be executed according to the flowchart of FIG. 13 with a device other than the printer and its results may be stored in the correction luminance storage unit 124. Even in such a case, the increase in cost of the laser unit 61 due to the higher range of output can be similarly suppressed.

(Effect of Exposure Correction)

Figure 10B:
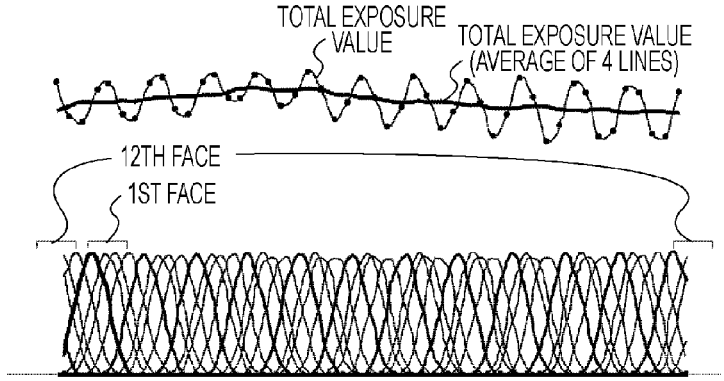

FIG. 10B shows the case where the luminance is not corrected for each polygonal face and for each beam. According to FIG. 10B, the total exposure amount in the sub-scanning direction is affected by the sub-scanning displacement of 4 beams, so that the exposure amount is changed with a 4-beam period, and the exposure amount change in the low-frequency component with a 48-line polygonal face period is appeared from the 4-line moving averaged total exposure amount. In other words, in the case of FIG. 10B, changes in exposure amount are shown based on whether the principal line interval of the laser beam is smaller than an ideal value. The exposure amount changes of the low-frequency component become a control target for suppressing the color density unevenness such as banding. In view of human visibility shown in FIG. 7B, the exposure amount change in the low-frequency component with a polygonal face period affects the human eyes more sensitively rather than the exposure amount change with a 4-beam period does.

According to the embodiment, as shown in FIG. 10A, a correcting method is proposed for not maintaining the total exposure amount constant but for maintaining the 4-line moving averaged total exposure amount substantially constant. According to FIG. 10A, during the above-mentioned calculation of the total exposure amount, by simultaneously calculating the 4-line moving averaged total exposure amount, the luminance is set for each beam so that the 4-line moving averaged total exposure amount is maintained substantially constant. In the specific established example of FIG. 10A, the 4-line moving averaged total exposure amount is maintained substantially constant, and also from FIG. 11B, it is understood that the concentration difference unevenness is corrected in the spatial frequency sensitive to the human visibility. Thereby, the resolution produced by the laser driver having a luminance modulating function 51 can be largely reduced. For example, when 12 bits have been conventionally required, the resolution can be reduced to 8 bits, or from 10 bits to 6 bits, largely reducing cost. The calculation method similarly employs the execution of the flowchart of FIG. 13 as described in the first embodiment.

Second Embodiment

According to the embodiment described above, the 4-line moving averaged total exposure amount is maintained substantially constant, while the luminance is variable for each face (the luminance of 4 beams within one face is the same). According to a second embodiment, the 4-line moving averaged total exposure amount is maintained substantially constant, while the luminance is variable for each face and the luminance of 4 beams is variable.

(Effect of Example when Exposure Correction Resolution is Deteriorated)

Figures 14A, 14B:
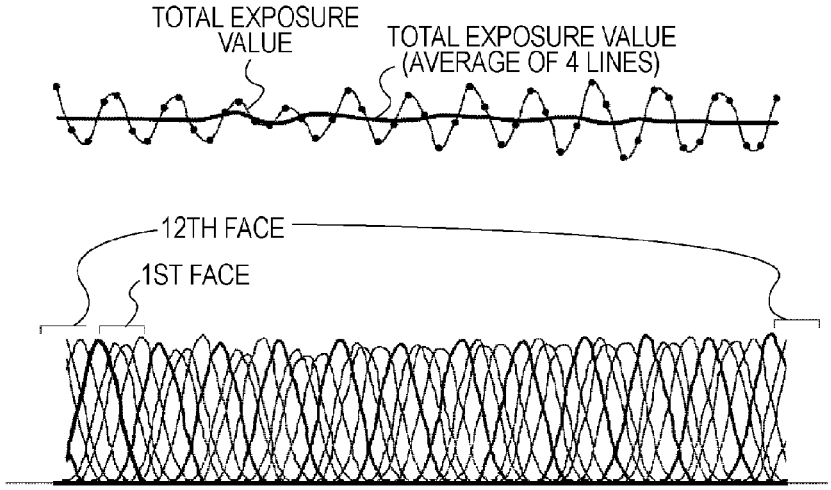
FIGS. 14A and 14B are drawings showing an example of the luminance correction values and luminance correcting situations according to a second embodiment.

FIG. 14A shows an example of the luminance correction value (luminance information) according to the second embodiment in which the luminance information is stored for each face and for each beam of the multi-laser beams. FIG. 14B is a drawing showing exposure amount correction situations according to the second embodiment. As shown in FIG. 14A, the resolution of an individual beam is deteriorated in decrements of 0.01 and the luminance is changed for each face and for each beam. The luminance correction may employ an error diffusion method. Namely, even when the luminance correction resolution is deteriorated, the correction resolution is compensated for the error with the luminance of front and rear beams. According to the second embodiment, even when the luminance correction resolution is deteriorated, by not equalizing the luminance of 4 beams, the 4-line moving averaged total exposure amount can be maintained substantially constant in the same way as in the first embodiment. Thereby, in the same way as in the first embodiment, the concentration difference unevenness can be efficiently corrected in the spatial frequency sensitive to the human visibility, reducing the cost of the laser unit 61.

Third Embodiment

According to the embodiments described above, the exposure amount is averaged by a simple moving average method with a plurality of lines. Whereas, according to a third embodiment, characteristics of an FIR digital low-pass filter are assimilated to the human visibility.

Figures 15A, 15B, 15C:
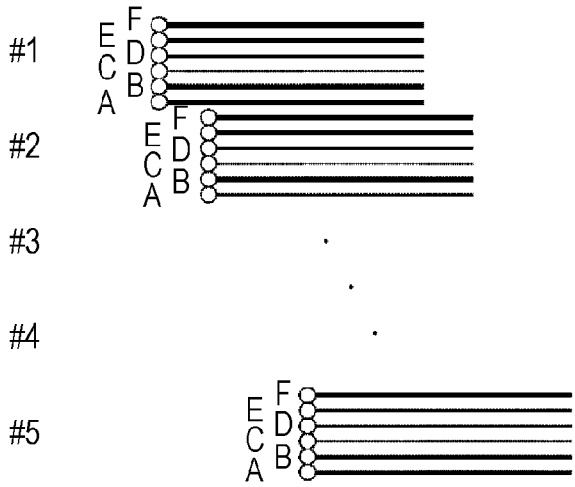
FIGS. 15A to 15C are drawings showing an example of luminance correcting situations according to a third embodiment.

FIG. 15A is a schematic image drawing of output images depicted with a laser optical system according to the third embodiment (5-face polygon, 6 beams for simultaneous writing, the resolution 1200 dpi, and the spot diameter 50 μm). FIG. 15B is a table of the sub-scanning displacement amount from the regular position generated due to the polygonal axis tangle, the polygonal face tangle, and the positional displacement of a plurality of laser beams, listed for each polygonal face and for each beam.

Namely, the concentration difference unevenness is generated with a 30-line period which is the product of the number of polygonal faces and the number of beams for simultaneous writing. FIG. 15C is a table showing whole divisors of the 30-line period, from which it is understood that the concentration difference unevenness can be generated with a 15-line, a 10-line, 6-line, and 5-line period as well as the 30-line period. However, according to the human visibility in a state of eyes separated by about 30 cm from printed images, the sensibility for the concentration difference at over 6 (line/min) is reduced so as to become difficult to discriminate differences, so that it may be sufficient that the concentration difference unevenness is corrected with a 30-line, a 15-line, and a 10-line period.

(Design of Digital Filter)

According to the third embodiment, not by a simple moving average method, but by applying the low-pass filter assimilated to the human visibility, a correction method is incorporated for maintaining the total exposure amount of the low-pass filter output substantially constant. FIG. 16A shows a configuration of a 6-step FIR filter; FIG. 16B shows a characteristic curve of the 6-step FIR filter along with a characteristic curve of the human visibility in a state of eyes separated by 286 mm from printed images, two curves being overlapped with each other; and FIG. 16C is a comparative table at several points.

From these characteristics, it is understood that the low-pass filter assimilated to the human visibility can be designed using standard techniques. Using this FIR low-pass filter, the concentration differences, such as 1.57 (line/mm), 3.15 (line/mm), 4.12 (line/mm), and 7.87 (line/mm), which are listed in FIG. 15C, can be made to have the same amplitude with a tinge of the human visibility added thereto. In such a manner, the correction can be made so as to limit the concentration difference unevenness with one round period below a predetermined value. Using the FIR filter shown in FIGS. 16A to 16C, the exposure amount change in the low-frequency component, from which the exposure amount change in the high-frequency component is removed or suppressed, can be more effectively extracted.

(Effect of Exposure Amount Correction)

Figure 17A:
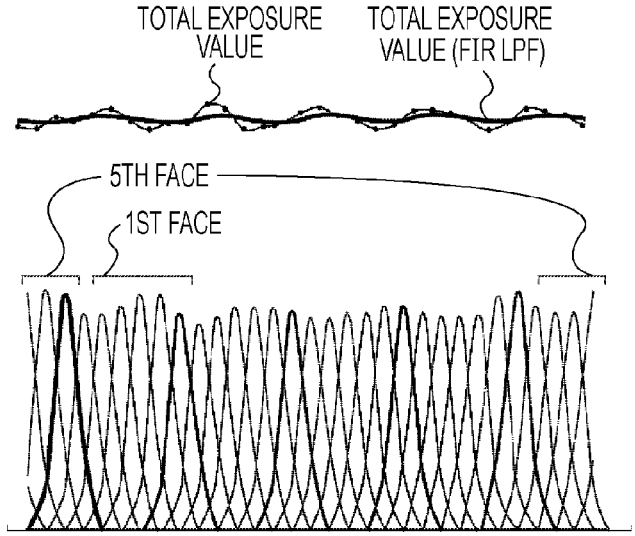
FIGS. 17A and 17B are drawings for illustrating relationships between total exposure amount and laser beam output.
Figure 17B:
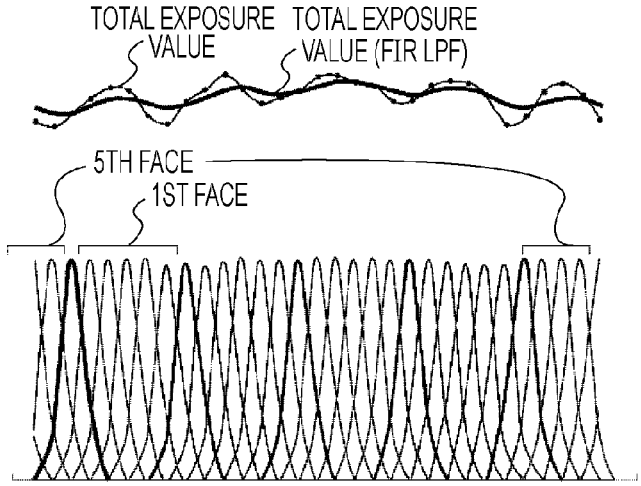
Figure 21A:
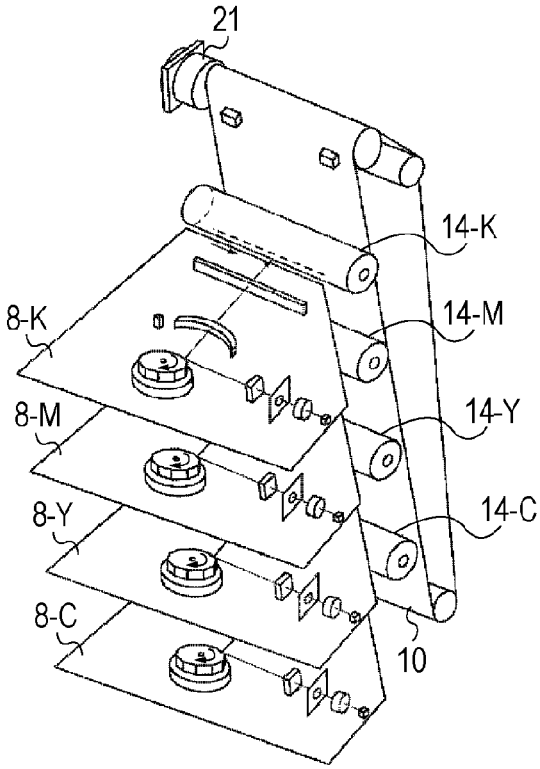
FIGS. 21A and 21B are drawings for showing a configuration of a tandem-type color image forming apparatus.
Figure 21B:
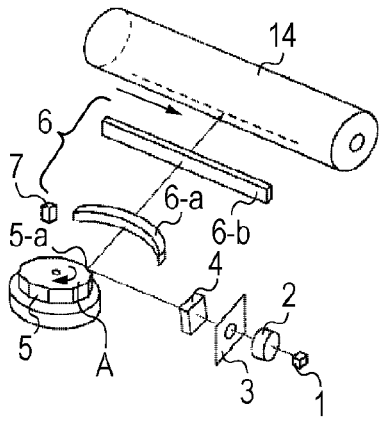

According to the third embodiment, the exposure amount corresponding to 30 lines in total for each polygonal face and each beam is corrected so that the total exposure amount after passing through the low-pass filter assimilated to the human visibility is maintained substantially constant. FIG. 17A shows an example of the total exposure amount and the total exposure amount after passing through the low-pass filter that are plotted for one rotation through the polygonal faces, (corresponding to 30 lines) according to the present embodiment, and FIG. 17B shows an example without any correction. In FIG. 17A, the amplitude of the high-frequency component of the exposure amount changes after correction is larger than that of the exposure amount changes of the low-frequency component in the exposure amount changes after correction. Occasionally, it is increased by a factor of n (n is an integer of 2 or more). This is because the amplitude of the high-frequency component in the exposure amount changes before correction is not a direct control target for suppressing the color density unevenness due to changes in the principal scanning line interval of the laser beam in the photosensitive drum 14. In the case of FIG. 17B, changes in exposure amount are shown based on whether the principal line interval of the laser beam is smaller than an ideal value. The exposure amount changes of the low-frequency component shown in FIG. 17B become a control target for suppressing the color density unevenness such as banding.

FIG. 18 shows data (luminance information) of the exposure correction example shown in FIG. 17A.

From FIG. 19A, according to the embodiment, it is understood that fluctuations of the maximum value as well as the minimum value of the luminance are small. The standard deviation is also reduced to about 70%, so that the correction may be made even if the luminance is not changed much. FIG. 19B is a data summary of the total exposure amount and the total exposure amount after passing through the low-pass filter for the present embodiment. There are few fluctuations in the total exposure amount after the low-pass filter. According to the embodiment, although the total exposure amount includes fluctuations in some measure, the change after passing through the low-pass filter is significantly suppressed and the standard deviation is effectively reduced to about a quarter of that of the example without correction. As described according to the embodiment in detail, the characteristics of the FIR digital low-pass filter are assimilated to the human visibility, so that amplitudes of various periods can be made the same amplitude with a tinge of the human visibility added thereto, enabling the data to be more objectively processed. According to the embodiment, the correction with excessive accuracies is not required and the luminance can be corrected even when the resolution is not unnecessarily improved. The FIR filter according to the embodiment is an example, so that without being limited to this, various low-pass digital filters may be obviously incorporated.

Fourth Embodiment

According to the embodiments described above, the cases where 2400 dpi, 4 beams, and the 12-face polygon are used and where 1200 dpi, 6 beams, and the 5-face polygon are used, have been exemplified; however, the invention is not limited to these, so that a plurality of beams, such as 5 beams, 6 beams, and 8 beams, may be obviously incorporated into the present invention. About the number of polygonal faces, 6 faces, 8 faces, and 10 faces may be obviously applied. The cases where the resolving power (resolution) is 4800 dpi, 2400 dpi, 1200 dpi, and 600 dpi may also be obviously incorporated into the present invention. According to a fourth embodiment, each of cases of 4800 dpi, 2400 dpi, 1200 dpi, and 600 dpi will be exemplified.

(Applications for Each Resolving Power)

FIG. 20A shows the case of 4800 dpi, 5 faces, and 8 beams; FIG. 20B the case of 2400 dpi, 10 faces, and 5 beams; FIG. 20C the case of 1200 dpi, 6 faces, and 6 beams; and FIG. 20D the case of 600 dpi, 8 faces, and 4 beams. The number of lines for one round the polygonal faces corresponds to the product of the number of polygonal faces and the number of beams for simultaneous writing, resulting in 40 lines, 50 lines, 36 lines, and 32 lines, respectively. The pitch for one round the polygonal faces results in 0.212 mm, 0.529 mm, 0.762 mm, and 1.355 mm, respectively. The frequency for one rotation of the polygonal faces results in inverses of the above pitches. The visibility in a state of eyes separated by 286 mm results in 0.176, 0.838, 0.982, and 0.937, respectively. From the first line of Tables, the frequency of one rotation of the polygonal faces and the visibility can be calculated. Numerals on the next line and lines below are calculated by sequentially substituting the divisors of the product of the number of polygonal faces and the number of beams for simultaneous writing. That is, whole integral multiples of the frequency of one rotation of the polygonal faces are shown. These are whole possible frequencies when it is assumed that the displacement due to the polygonal face tangle and a plurality of laser beams is randomly generated. By the completion of these tables, the whole visibility is calculated. According to the embodiment, when the frequency is more than 6 (line/mm), from which the human visibility is reduced, the visibility is reduced to 0.076 or less so as to become difficult to discriminate, so that it is not necessary to correct color density of the frequencies more than the above. These ranges are shown with gray zones in FIGS. 20A to 20D. The correction may be made until the 40-line period, the 25-line period, the 9-line period, and the 4-line period in FIGS. 20A to 20D, respectively. The correction calculation method may employ the method described in the above embodiments.

According to the fourth embodiment, with the resolution, the number of polygonal faces, and the number of laser beams for simultaneous writing, which are established in advance, the concentration difference changes with the period sensitive to the human visibility are corrected among concentration difference changes with various periods determined in advance and existing in pitches (mm) of the period of one round the polygonal faces. More in detail, within the pitches (mm) of the period of one round the polygonal faces, there are the number of lines corresponding to the product of the number of polygonal faces and the number of beams for simultaneous writing and a plurality of kinds of the pitches (mm) of the period of the number of lines, which are deviators of the number of lines corresponding to the product. Among the plurality of kinds of the pitches (mm) of the period of the number of lines, the pitches (mm) of the period corresponding to the frequency sensitive to the human visibility are corrected. In the correction, the frequencies, which are inverses of periods, sensitive to the human visibility may be selected to have 6 (line/mm) or less, for example. In such a manner, even when the resolution, the number of polygonal faces, and the number of beams for simultaneous writing are set at specific values, the same effect as that of the first to third embodiments can be obtained.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2007-172748 filed Jun. 29, 2007 and the benefit of Japanese Patent Application No. 2008-148203 filed Jun. 5, 2008, both of which are hereby incorporated by reference herein in their entirety.

What is claimed is:

1. An image forming apparatus having a light-emitting unit configured to emit a laser beam, a rotatable polygon mirror configured to deflect the laser beam emitted by the light-emitting unit, and an image bearing member bearing images formed thereon by the laser beam deflected with the rotatable polygon mirror, and configured to suppress density unevenness due to exposure amount changes in a sub-scanning direction, which are caused by changes in a main scanning line interval of the laser beam on the image bearing member when forming images on the image bearing member by deflecting the laser beam with the rotatable polygonal mirror, the image forming apparatus comprising:

an exposure amount correcting unit configured to have a control target of exposure amount changes of a low-frequency component, in which exposure amount changes of a high-frequency component in the exposure amount changes in the sub-scanning direction are suppressed or removed, and to correct an exposure amount so as to suppress the exposure amount changes of the low-frequency component of the control target, a storage unit configured to store luminance information of the laser beam for suppressing exposure amount changes in the low-frequency component for each face of the rotatable polygonal mirror, wherein the exposure amount correcting unit corrects the exposure amount on the basis of the luminance information stored in the storage unit, wherein the amplitude of the high-frequency component in the exposure amount changes corrected by the exposure amount correcting unit is larger than that of the exposure amount changes of the low-frequency component in the exposure amount changes corrected by the exposure amount correcting unit.

2. The apparatus according to claim 1, wherein the laser beam is multi-laser beams and the luminance information is stored in the storage unit for each polygonal face as well as for each beam of the multi-laser beams, so that the exposure amount correcting unit corrects the exposure amount for each of the beams on the basis of the luminance information stored in the storage unit.

3. The apparatus according to claim 1, wherein the exposure amount changes in the sub-scanning direction are based on the exposure effect from a plurality of main-scanning lines continuously exposed by a noticed main-scanning line.

4. The apparatus according to claim 1, wherein the exposure amount changes in the low-frequency component are based on the output of a low-pass filter.

5. A control method of an image forming apparatus having a light-emitting unit configured to emit a laser beam, a rotatable polygon mirror configured to deflect the laser beam emitted by the light-emitting unit, a storage unit, and an image bearing member bearing images formed thereon by the laser beam deflected with the rotatable polygon mirror, and configured to suppress density unevenness due to exposure amount changes in a sub-scanning direction, which are caused by changes in a main scanning line interval of the laser beam on the image bearing member when forming images on the image bearing member by deflecting the laser beam with the rotatable polygonal mirror, the control method comprising a step of correcting an exposure amount by having a control target of exposure amount changes of a low-frequency component, in which exposure amount changes of a high-frequency component in the exposure amount changes in the sub-scanning direction are suppressed or removed, so as to suppress the exposure amount changes of the low-frequency component of the control target, wherein the correcting step corrects the exposure amount on the basis of a luminance information of the laser beam for suppressing exposure amount changes in the low-frequency component for each face of the rotatable polygonal mirror, the luminance information being stored in the storage unit, wherein the amplitude of the high-frequency component in the exposure amount changes corrected by the exposure amount correcting step is larger than that of the exposure amount changes of the low-frequency component in the exposure amount changes corrected by the exposure amount correcting.

* * * * *